US006695432B2

(12) United States Patent
Kanda

(10) Patent No.: US 6,695,432 B2
(45) Date of Patent: Feb. 24, 2004

(54) INK-JET RECORDING APPARATUS PERFORMING MULTI-PASS RECORDING, AND INK-JET RECORDING METHOD

(75) Inventor: Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/157,974

(22) Filed: May 31, 2002

(65) Prior Publication Data

US 2002/0186274 A1 Dec. 12, 2002

(30) Foreign Application Priority Data

Jun. 7, 2001 (JP) ..... 2001-172739

(51) Int. Cl.[7] ..... B41J 2/15
(52) U.S. Cl. ..... 347/41; 347/14; 347/37
(58) Field of Search ..... 347/43, 19, 41, 347/9, 12, 16, 37, 14

(56) References Cited

U.S. PATENT DOCUMENTS 4,723,129 A 2/1988 Endo et al. ..... 347/12
4,740,796 A 4/1988 Endo et al. ..... 347/9
5,568,169 A * 10/1996 Dudek et al. ..... 347/43
5,696,542 A 12/1997 Matsubara et al. ..... 347/12
6,007,181 A 12/1999 Takahashi et al.
6,089,697 A * 7/2000 Tajika et al. ..... 347/43
6,102,511 A 8/2000 Shioya et al. ..... 347/9

FOREIGN PATENT DOCUMENTS

JP 7-47695 2/1995

* cited by examiner

*Primary Examiner*—Lamson D Nguyen
(74) *Attorney, Agent, or Firm*—Fitzpatrick, Cella, Harper & Scinto

(57) ABSTRACT

The present invention provides an ink-jet recording method that allows a time for ink to penetrate into the recording medium and to be fixed thereto, and prevents density irregularity, color unevenness, blot between colors, and stain of the recording medium caused by contact between the recording head and the recording medium. When conducting multi-pass recording comprising the step of executing a plurality of runs of main scanning to each recording area while relatively moving the recording head which discharges ink on the recording medium, it is made possible to select a recording mode from a plurality of recording modes of different numbers of runs of main scanning, and a rest period, during which recording is discontinued after each run of main scanning, is set in response to the number of runs of main scanning corresponding to the selected recording mode.

18 Claims, 21 Drawing Sheets

| | IMAGE AREA A | IMAGE AREA B |
|---|---|---|
| TIME DIFFERENCE BETWEEN 1ST AND 2ND SCANS | T1 + T = 0.35 SEC + 0.5 SEC = 0.85 SEC | T2 + T = 0.15 SEC + 0.5 SEC = 0.65 SEC |
| TIME DIFFERENCE BETWEEN 2ND AND 3RD SCANS | T2 + T = 0.15 SEC + 0.5 SEC = 0.65 SEC | T1 + T = 0.35 SEC + 0.5 SEC = 0.85 SEC |
| TIME DIFFERENCE BETWEEN 3RD AND 4TH SCANS | T1 + T = 0.35 SEC + 0.5 SEC = 0.85 SEC | T2 + T = 0.15 SEC + 0.5 SEC = 0.65 SEC |
| TIME DIFFERENCE BETWEEN 4TH AND 5TH SCANS | T2 + T = 0.15 SEC + 0.5 SEC = 0.65 SEC | T1 + T = 0.35 SEC + 0.5 SEC = 0.85 SEC |

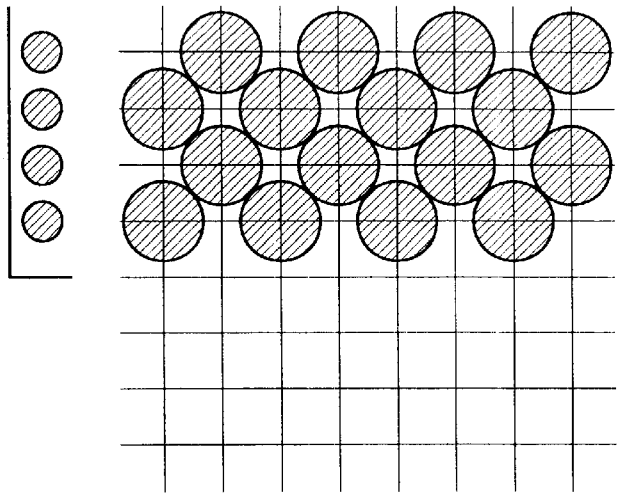
FIG. 6A
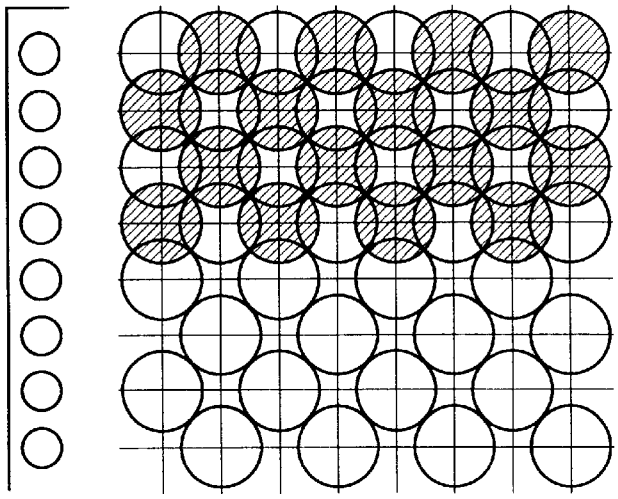
FIG. 6B
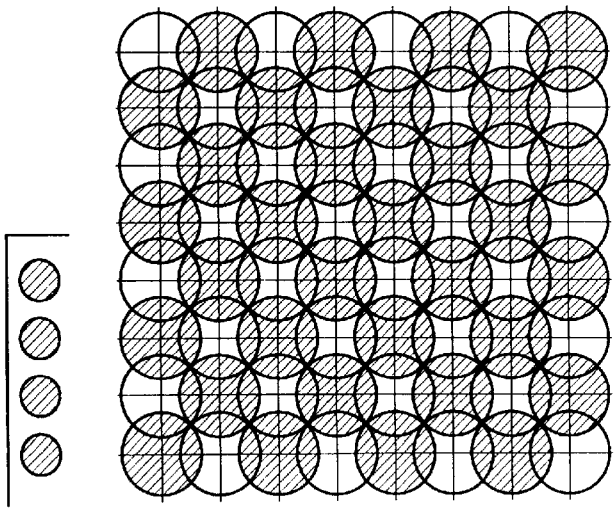
FIG. 6C
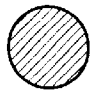
CHECKERS PATTERN A
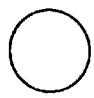
CHECKERS PATTERN B (REVERSE PATTERN OF CHECKERS PATTERN A)

| | IMAGE AREA A | IMAGE AREA B |
|---|---|---|
| TIME DIFFERENCE BETWEEN 1ST AND 2ND SCANS | T1 + T<br>= 0.35 SEC + 1.5 SEC<br>= 1.85 SEC | T2 + T<br>= 0.15 SEC + 1.5 SEC<br>= 1.65 SEC |
| TIME DIFFERENCE BETWEEN 2ND AND 3RD SCANS | T2 + T<br>= 0.15 SEC + 1.5 SEC<br>= 1.65 SEC | T1 + T<br>= 0.35 SEC + 1.5 SEC<br>= 1.85 SEC |

FIG. 12

| | IMAGE AREA A | IMAGE AREA B |
|---|---|---|
| TIME DIFFERENCE BETWEEN 1ST AND 2ND SCANS | T1 + T<br>= 0.35 SEC + 0.5 SEC<br>= 0.85 SEC | T2 + T<br>= 0.15 SEC + 0.5 SEC<br>= 0.65 SEC |
| TIME DIFFERENCE BETWEEN 2ND AND 3RD SCANS | T2 + T<br>= 0.15 SEC + 0.5 SEC<br>= 0.65 SEC | T1 + T<br>= 0.35 SEC + 0.5 SEC<br>= 0.85 SEC |
| TIME DIFFERENCE BETWEEN 3RD AND 4TH SCANS | T1 + T<br>= 0.35 SEC + 0.5 SEC<br>= 0.85 SEC | T2 + T<br>= 0.15 SEC + 0.5 SEC<br>= 0.65 SEC |
| TIME DIFFERENCE BETWEEN 4TH AND 5TH SCANS | T2 + T<br>= 0.15 SEC + 0.5 SEC<br>= 0.65 SEC | T1 + T<br>= 0.35 SEC + 0.5 SEC<br>= 0.85 SEC |

FIG. 13

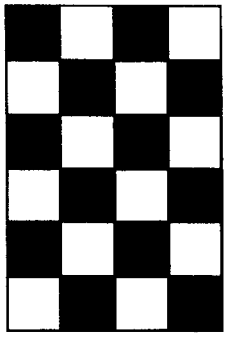
FIG. 14A
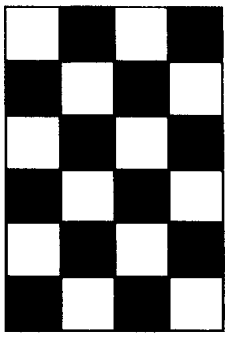
FIG. 14B
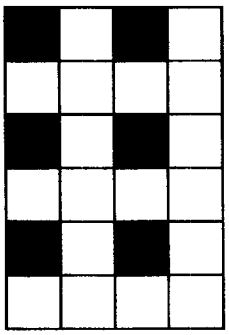
FIG. 15A
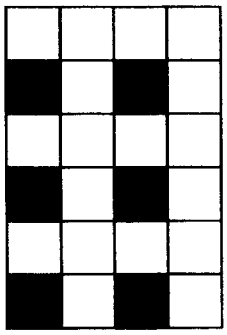
FIG. 15B
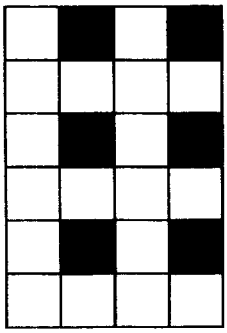
FIG. 15C
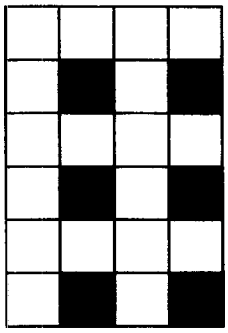
FIG. 15D
| REST PERIOD | COLOR UNEVENNESS, DENSITY IRREGULARITY | | PAPER STAIN | |
|---|---|---|---|---|
| | 2Pass | 4Pass | 2Pass | 4Pass |
| 0.0 (SEC) | × | × | ○ | ○ |
| 0.5 (SEC) | × | ○ | ○ | ○ |
| 1.0 (SEC) | △ | ○ | ○ | × |
| 1.5 (SEC) | ○ | ○ | ○ | × |
| 2.0 (SEC) | ○ | ○ | ○ | × |
| 2.5 (SEC) | ○ | ○ | △ | × |
FIG. 16

| REST PERIOD | COLOR UNEVENNESS, DENSITY IRREGULARITY | | PAPER STAIN | | BLOT BETWEEN COLOR AND BLACK | |
|---|---|---|---|---|---|---|
| | 2Pass | 4Pass | 2Pass | 4Pass | 2Pass | 4Pass |
| 0.0 (SEC) | × | × | ○ | ○ | × | × |
| 0.5 (SEC) | × | ○ | ○ | ○ | × | ○ |
| 1.0 (SEC) | △ | ○ | ○ | × | × | ○ |
| 1.5 (SEC) | ○ | ○ | ○ | × | ○ | ○ |
| 2.0 (SEC) | ○ | ○ | ○ | × | ○ | ○ |
| 2.5 (SEC) | ○ | ○ | △ | × | ○ | ○ |

FIG. 21

INK-JET RECORDING APPARATUS PERFORMING MULTI-PASS RECORDING, AND INK-JET RECORDING METHOD

BACKGROUND OF THE INVENTION

1. Field of the Invention

The present invention relates to an ink-jet recording apparatus and an ink-jet recording method. More particularly, the invention relates to an ink-jet recording apparatus and an ink-jet recording method performing multi-pass recording in which an image is formed by executing a plurality of runs of main scanning moving a recording head discharging ink a plurality of times relative to a recording medium for the individual recording areas on the recording medium.

2. Description of the Related Art

A recording apparatus such as a printer, copying machine, or facsimile machine; or a composite type electronic device such as a computer or a wordprocessor; or a recording apparatus used as an output device such as a workstation, has a configuration to permit recording onto a recording medium such as a sheet of paper or a plastic sheet on the basis of the image information including character information and the like.

These recording apparatuses can be classified, in terms of their recording method, into ink-jet, wire-dot, thermal and laser beam recording apparatuses. From among these recording apparatuses, the ink-jet type of recording apparatus (ink-jet recording apparatus) accomplishes recording by discharging ink from a recording means such as a recording head onto a recording medium, and has excellent features of easy refinement, high speed, quietness, and low cost.

On the other hand, there is an increasing demand for color recording, and many color ink-jet recording apparatuses have been developed. The ink-jet recording apparatus uses a recording head comprising a plurality of ink discharge ports and liquid paths for ink discharge to improve the recording speed, and generally has a plurality of recording heads.

FIG. 1 illustrates a schematic configuration of a general printer section of the type in which recording is performed by causing a recording head to scan a plurality of times a sheet of recording paper P. In FIG. 1, reference numeral 101 represents four different ink cartridges. Each of the four cartridges comprises an ink tank containing either black, cyan, magenta or yellow ink, and a recording head 102.

FIG. 2 illustrates a cross-sectional view of a discharge port provided in each recording head, as viewed from the z-direction. As shown in FIG. 2, a plurality of discharge ports 201 are arranged at prescribed intervals on the recording head 102.

Referring again to FIG. 1, reference numeral 103 represents a paper feeding roller, which rotates in the arrow direction in FIG. 1 while pressing sheets of recording paper P, together with an auxiliary roller 104, thus feeding the recording paper P from time to time in the y-direction; reference numeral 105, a pair of paper feeding roller, also feed recording paper and plays a role of pressing the recording paper P, similar to the paper feeding roller 103 and the auxiliary roller 104; and reference numeral 106, a carriage, supports the four ink cartridges 101 and causes them to move and scan upon recording. When recording is not conducted, or when carrying out a recovery operation of the recording head, the four ink cartridges are waiting at a home position (h), as shown by the dotted line in FIG. 1.

Before starting recording, and upon receipt of a recording start command, the carriage 106 at the home position in FIG. 1 discharges ink from a plurality of discharge ports 201 (shown in FIG. 2) on the recording head 102 while moving in an x-direction for recording. When the recording of data at the end of the paper is completed, the carriage 106 returns to the home position h, and performs recording again in the x-direction.

When recording an image or the like, various factors including the properties of each color, gradation and uniformity need to be considered. In particular, with regard to uniformity, it is known that a slight variation between nozzles produced during the recording head manufacturing process exerts an influence on the ink discharge amount of each nozzle or the direction of ink discharge upon recording, leads to deterioration of the image quality as a density irregularity of the recorded image.

A concrete example of this density irregularity will be provided, with reference to FIGS. 3 and 4. In FIG. 3A, reference numeral 31 represents a recording head comprising eight nozzles 32; and reference numeral 33 represents ink drops discharged by the nozzles 32, which should ideally be discharged in uniform amounts and in a uniform direction, as shown in FIG. 3. When such a discharge is achieved, dots of a uniform size are dropped, as shown in FIG. 3B, and a uniform image, free from density irregularity as a whole, is obtained (as shown in FIG. 3C).

However, nozzles are not uniform as described above. If recording is conducted with these nozzles as they are, variations in size and the irregular direction of ink drops discharged from the individual nozzles occurs, as shown in FIG. 4A, and the ink drops reach the recording medium in a non-uniform manner as shown in FIG. 4B. According to FIG. 4B, blank portions, which cannot fully satisfy an area factor of 100%, are present periodically in the head's main scanning direction, or dots overlap, or a white line, as observed at the center of FIG. 4B is produced.

A collection of dots deposited in the state as described above (as shown in FIG. 4B) takes a density distribution, as shown in FIG. 4C, and finally, as viewed by ordinary human eyes, these phenomena are sensed as density irregularities. Apart from this, when there are variations in the paper feed amount, lines may become apparent in the recorded image.

To avoid such density irregularities, U.S. Pat. No. 5,696,542 discloses the following method, which will briefly be described with reference to FIGS. 4 and 5. According to this method, three runs of main scanning of a recording head 31 are conducted (FIG. 5A) to complete a recording area shown in FIG. 5B, and a unit area of four pixels accounting for half of the recording area is completed with two passes. In this case, eight nozzles of the recording head are divided into two groups including four upper nozzles and four lower nozzles. Dots recorded in a single run of main scanning by a nozzle are those resulting from a prescribed image data thinned to about a half in accordance with a prescribed image data arrangement (printed pattern). During the second run of main scanning, the remaining half of the dots are embedded in the printed medium to complete the recording of a unit area of four pixels. This recording method is hereinafter referred to as the multi-pass recording method.

According to such a recording method, even when using a head equivalent to the recording head shown in FIG. 4, the effect of variations intrinsic to the individual nozzles on the recorded image is reduced by half, resulting in a recorded image as shown in FIG. 5B, the black and white lines observed in FIG. 4B are not very conspicuous. Therefore, the density irregularities are alleviated to a large extent as compared with the case shown in FIG. 4C, as shown in FIG. 5C.

When conducting such multi-pass recording, in the first and second runs of main scanning, image data are divided in a mutually compensating form in accordance with a prescribed printed pattern. For this printed pattern, it is common to use one printed pattern that results in a checkers pattern for each pixel horizontally and vertically formed. This printed pattern is hereinafter referred to as the checkers pattern. By using such a printed pattern, in a unit recording area (in units of four pixels in this case), recording is completed by the first run of main scanning for recording the checkers pattern and the second run of main scanning for recording the reverse checkers pattern. The checkers pattern used in the second run of main scanning is just the reverse of the checkers pattern used in the first run of main scanning.

FIGS. 6A, 6B, and 6C illustrate how recording on a certain area is worked out when using the checkers and the reverse checkers printed patterns. In FIG. 6A, printed patterns are shown with checkers pattern A and checkers pattern B, and the pattern B is just the reverse of the pattern A. In the first run of main scanning in FIG. 6A, recording is carried out with the checkers printed pattern by using the four lower nozzles (FIG. 6A). Then, in the second run of main scanning, paper is fed by four pixels (½ head length), and recording is performed with the reverse checkers printed pattern (shown in FIG. 6B). In the third run of main scanning, paper is fed again by four pixels (½ head length), and recording is effected again with the checkers printed pattern (shown in FIG. 6C). A unit recording area of four pixels is thus completed in each run of main scanning by sequentially and alternately applying paper feeding by four pixels as a unit, and by the recording of checkers and reverse checkers printed patterns.

As described above, a high-quality image free from density irregularity can be obtained by completing an image in each recording area with two kinds of nozzles.

A technique of recording a high-quality image free from density irregularity or color unevenness by ensuring a time for ink penetration and fixing into a recording medium is disclosed in Japanese Patent Laid-Open No. 07-47695. The method will be briefly described as follows. The recording of a high-quality image free from density irregularity or color unevenness is achieved by recording a line to be recorded by reciprocal record scanning of a recording head, and keeping the recording head waiting for a prescribed waiting time at a position where the recording head stops between the forward and backward runs of the scanning head.

However, Japanese Patent Laid-Open No. 07-47695 does not teach or support a method where an image is completed by multi-pass recording, and it is unknown whether or not an effect is available by applying the technique of that Laid-Open Publication to the multi-pass recording method.

The present inventors carried out experiments of the multi-pass recording method and discontinues recording for a prescribed period of time for each run of record scanning, and noted the number of runs of record scanning to complete an image, density irregularity, color unevenness, blotting between colors, and staining of the recording medium caused by contact between the recording head and the recording medium. As a result, the inventors obtained the following findings. As the number of runs of record scanning increases, density irregularity, color unevenness and blotting between colors are reduced, and the staining of the recording medium becomes more serious.

These phenomena are attributable to the fact that the multi-pass recording method can prevent density irregularities, and on the other hand, that an increased number of runs of record scanning corresponds to a smaller number of dots recorded per unit time and per unit area, and this leads to a change in penetration or fixing status into the recording medium. Accordingly, as an increased number of runs of record scanning are required for completing the image areas and more time is required before the completion of an image, a phenomenon known as cockling, in which waves are produced in the recording medium (particularly ordinary-paper-based recording medium), becomes more serious, and the contact between the recording head and the recording medium causes more serious staining of the recording medium.

SUMMARY OF THE INVENTION

The present invention was developed in view of the above-mentioned circumstances, and has an object to provide an ink-jet recording apparatus and an ink-jet recording method which ensure a time for penetration and fixing of ink into the recording medium, and permit recording of a high-quality image by preventing density irregularity, color unevenness, blotting between colors, and staining of the recording medium caused by contact between the recording head and the recording medium.

To achieve the aforementioned object, the present invention provides an ink-jet recording apparatus comprising: main scanning means for performing main scanning, which moves a recording head discharging ink above a recording medium, and conducts recording by discharging the ink from the recording head onto the recording medium; recording controlling means for executing a plurality of runs of main scanning of the recording head by the main scanning means to a recording area of the recording medium, and for performing multi-pass recording, which completes an image on the recording area; recording mode setting means, which sets a recording mode from a plurality of recording modes with a different number of runs of the main scanning by the multi-pass recording to the recording area; and rest period setting means, which sets a rest period during which recording is discontinued after the individual runs of main scanning in the multi-pass recording.

The ink-jet recording method of the present invention, which carries out main scanning by moving a recording head discharging ink above a recording medium, and conducts recording onto the recording medium by discharging the ink from the recording head comprising: a recording mode selecting step of selecting a recording mode from a plurality of recording modes of a different number of runs of the main scanning for the recording and when performing multi-pass recording, which completes an image for the recording area, by applying a plurality of runs of the main scanning to the recording area of the recording medium; a rest period setting step of setting a rest period during which recording is discontinued after each run of main scanning in the multi-pass recording in response to the number of runs of main scanning corresponding to the selected recording mode; and a step of conducting recording in response to the selected recording mode.

More specifically, in the present invention, when performing multi-pass recording of executing a plurality of runs of main scanning, for each recording area in which the recording head discharging the ink to the recording medium is moved relatively, a plurality of recording modes of a different number of runs of main scanning is provided for each recording area, and a rest period during which recording is discontinued after a run of main scanning is set in response to the number of runs of main scanning of the recording mode.

In this case, the rest period for a recording mode setting forth more runs of main scanning should preferably be shorter than the rest period for a recording mode setting forth a fewer runs of main scanning.

By doing as described above, in multi-pass recording, it is possible to set a rest period, taking into account the amount of ink discharged per unit time or per unit area, the response to the number of runs of main scanning to each area, and the time required for completing the recording.

It is therefore possible to record a high-quality image by ensuring a time for penetration and fixing of ink into the recording medium, and preventing density irregularity, color unevenness, blotting between colors, and staining of the recording medium caused by contact between the recording head and the recording medium.

Further objects, features and advantages of the present invention will become apparent from the following description of the preferred embodiments with reference to the attached drawings.

BRIEF DESCRIPTION OF THE DRAWINGS

FIGS. 6A–6C illustrate a typical printed pattern used in the multi-pass recording method.

FIG. 12 illustrates a time difference between runs of scanning in a two-pass recording area in an embodiment of the invention.

FIG. 13 illustrates a time difference between runs of scanning in a four-pass recording area in an embodiment of the invention.

FIGS. 14A and 14B illustrates a typical printed pattern used in two-pass recording in an embodiment of the invention.

FIGS. 15A–15D illustrate a typical printed pattern used in four-pass recording in an embodiment of the invention.

FIG. 16 is a table showing the rest period, the number of recording passes, and evaluation of the image-quality in the first embodiment of the invention.

FIG. 21 is a table showing the rest period, the number of recording passes, and evaluation of the image quality in the second embodiment of the invention.

DESCRIPTION OF THE PREFERRED EMBODIMENTS

Preferred embodiments of the present invention will now be described in detail with reference to the attached drawings.

In this specification, the term "record" (sometimes referred to as "print") shall mean not only forming information such as characters or graphics, but also forming an image, a figure, or a pattern broadly on a recording medium, whether it is significant or not, or irrespective of whether or not it is actualized into a form visually sensible, or fabricating a medium.

The term "recording medium" shall mean not only paper used in ordinary recording apparatuses, but also, more widely, media capable of receiving ink such as cloth, plastic film, metal sheet, glass, ceramics, wood, and leather.

The term "ink" (sometimes referred to as a "liquid") should be interpreted in a broader sense of the word as in the above-mentioned definition of the term "record (print)", and shall mean a liquid capable of being subjected to forming an image, a figure or a pattern, or fabricating a recording medium, or processing of ink (for example, coagulation or insolubilization of a coloring agent in ink imparted to a recording medium) by being applied to the recording medium.

[Overall Configuration of the Recording Apparatus]

Figure 1:
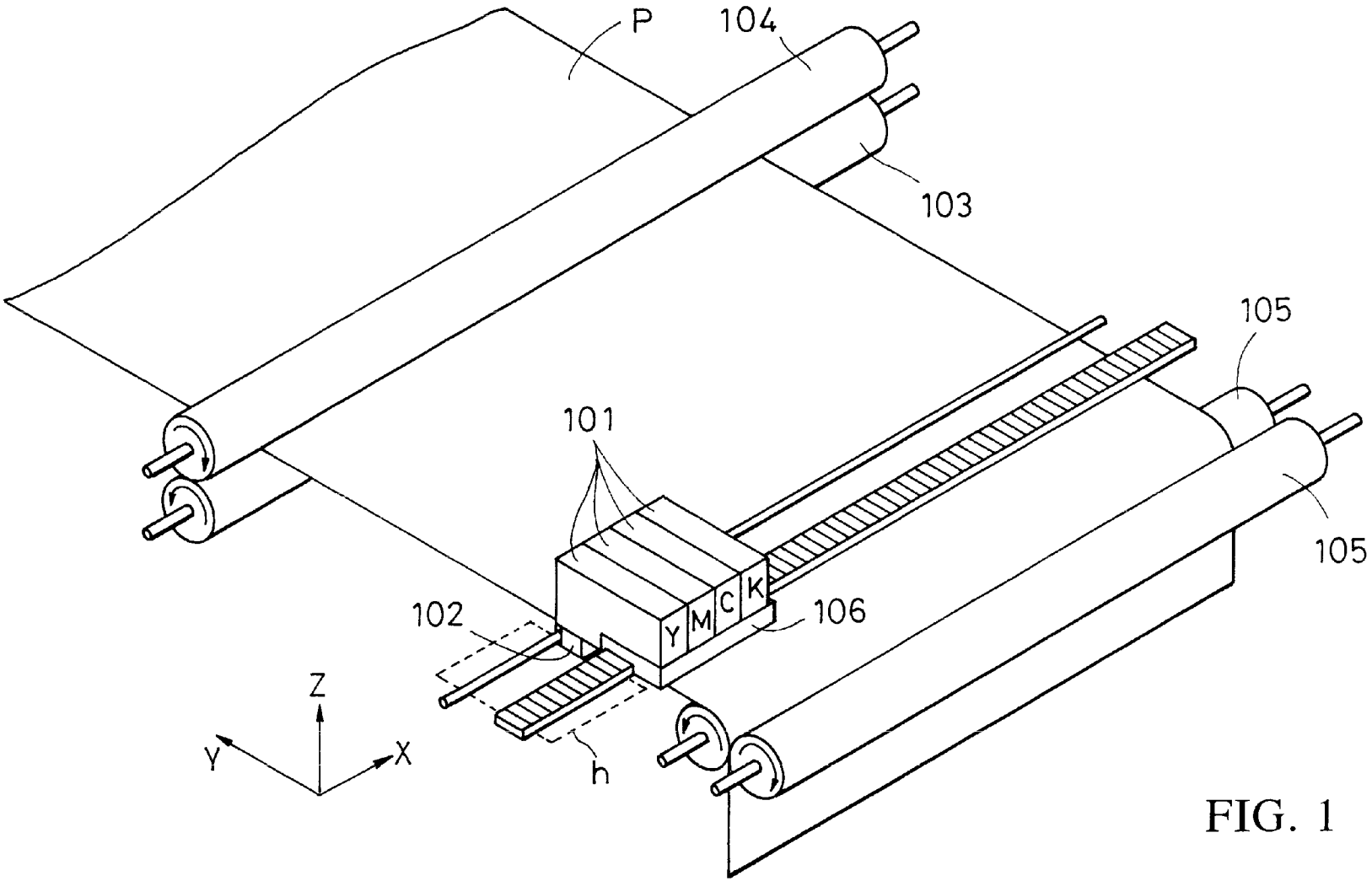
FIG. 1 illustrates a schematic configuration of a general ink-jet recording apparatus.
Figure 2:
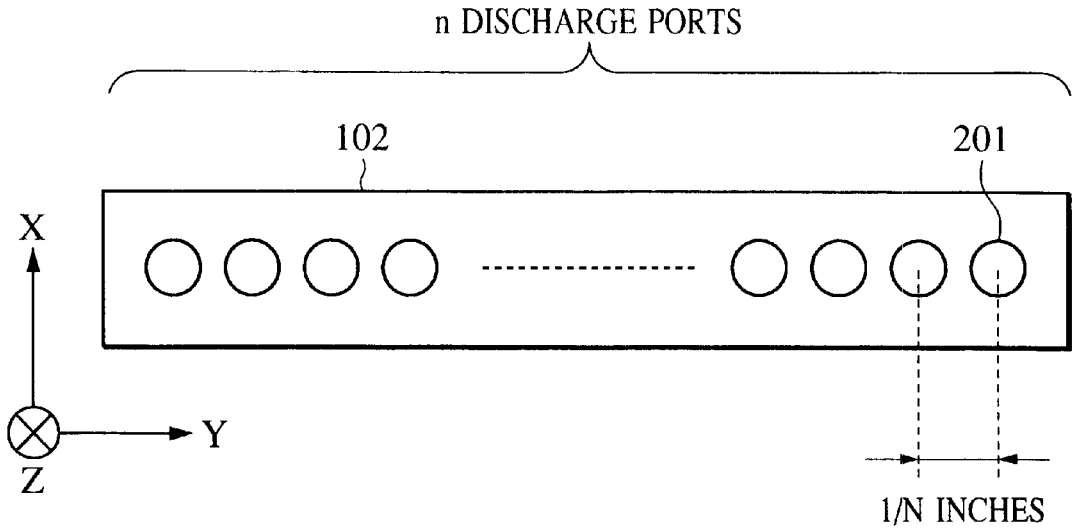
FIG. 2 schematically illustrates the nozzle arrangement of a recording head.
Figure 3C:
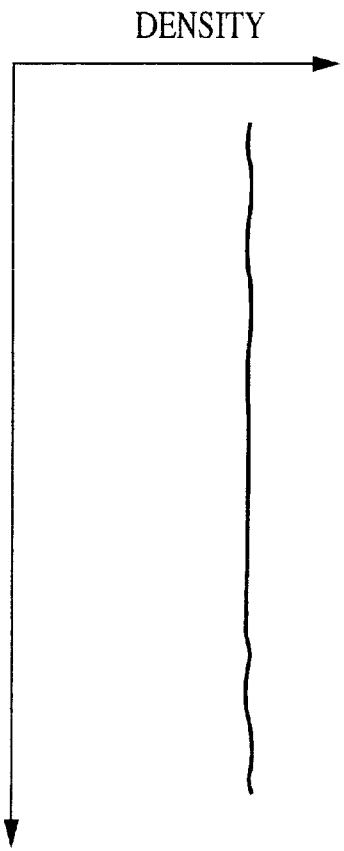
FIGS. 3A–3C illustrate an ideal recording status in an ink-jet recording apparatus.
Figure 3B:
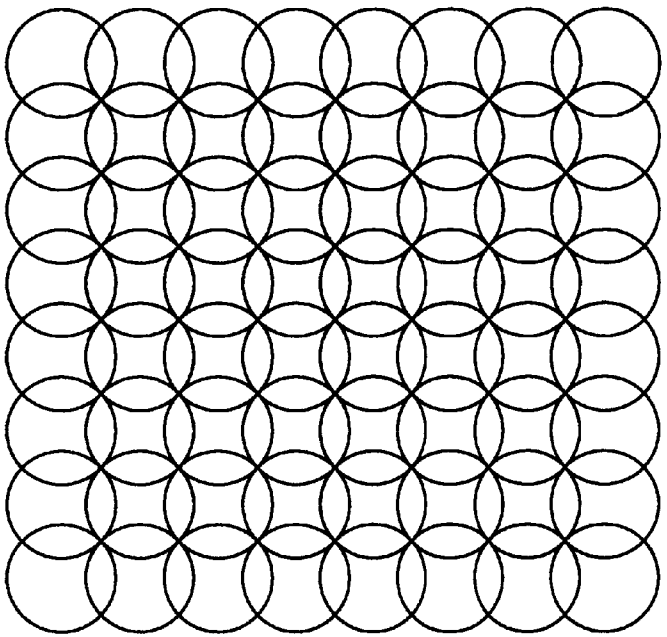
Figure 3A:
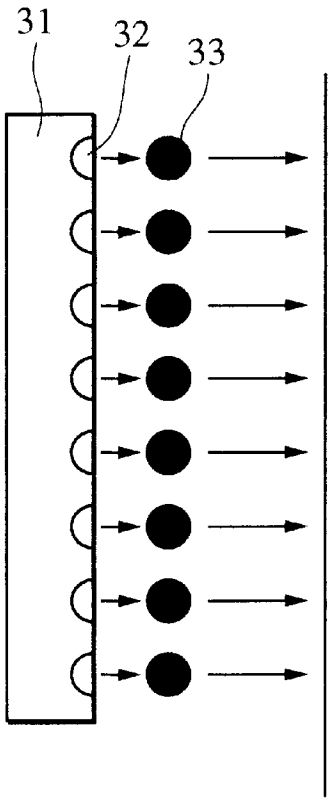
Figure 4C:
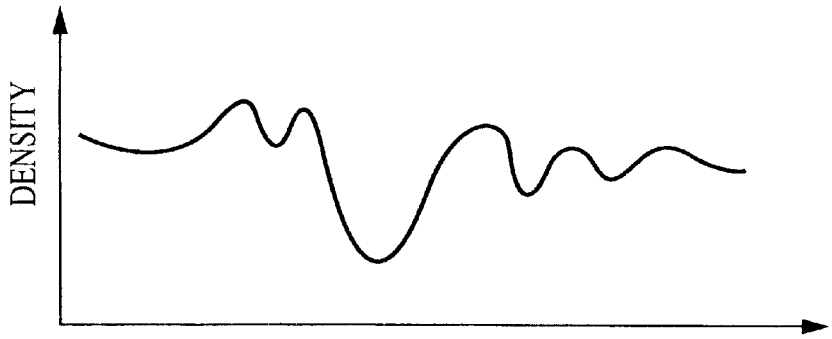
FIGS. 4A–4C illustrate a recording status producing density irregularity in the ink-jet recording apparatus.
Figure 4B:
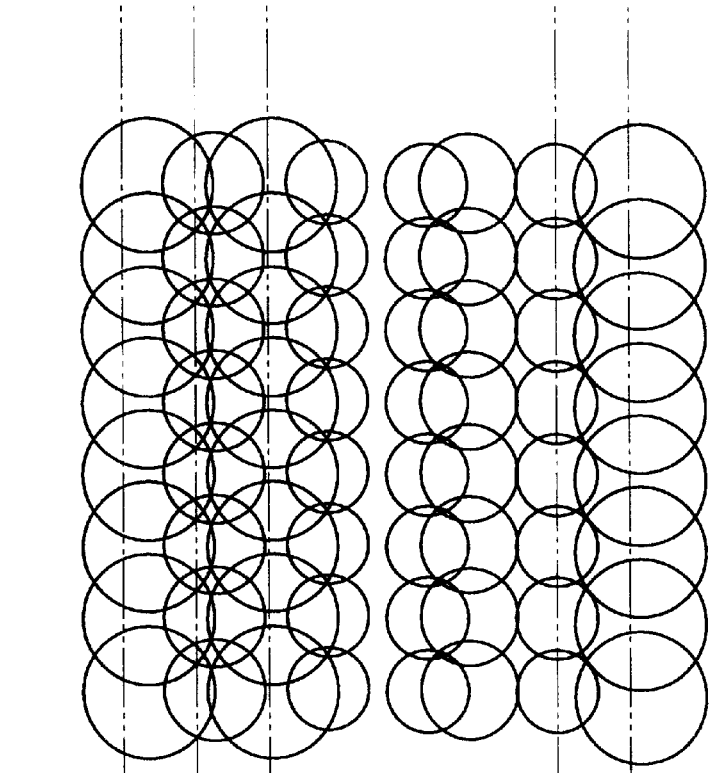
Figure 4A:
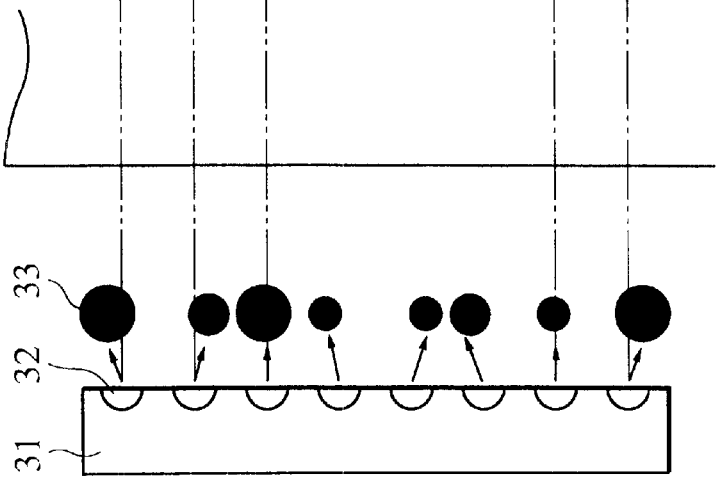
Figure 5C:
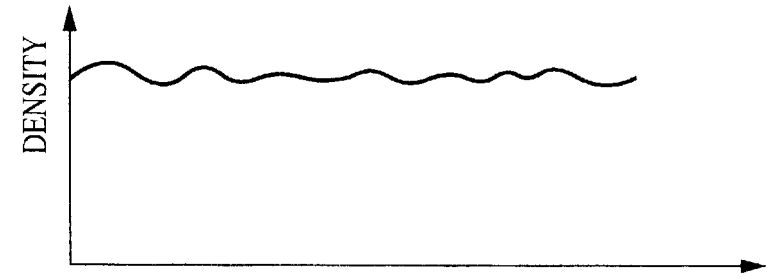
FIGS. 5A–5C illustrate a recording status based on the multi-pass recording method.
Figure 5B:
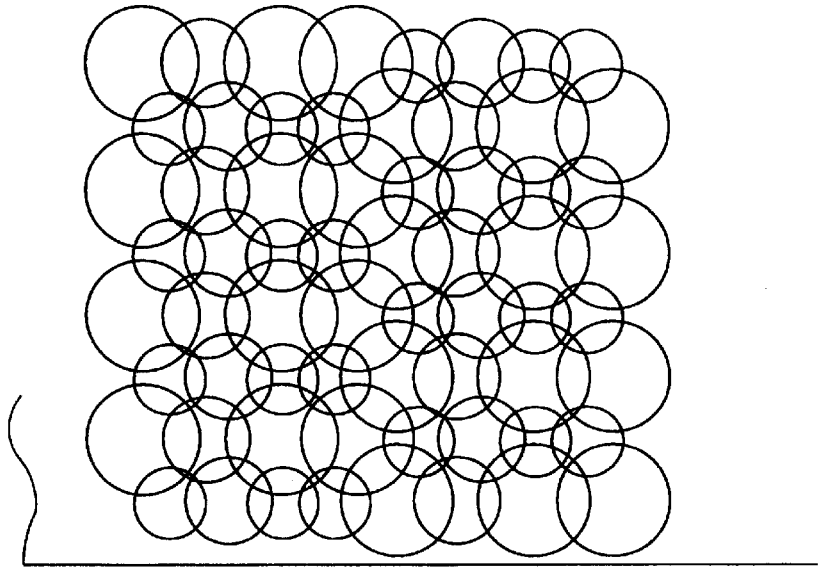
Figure 5A:
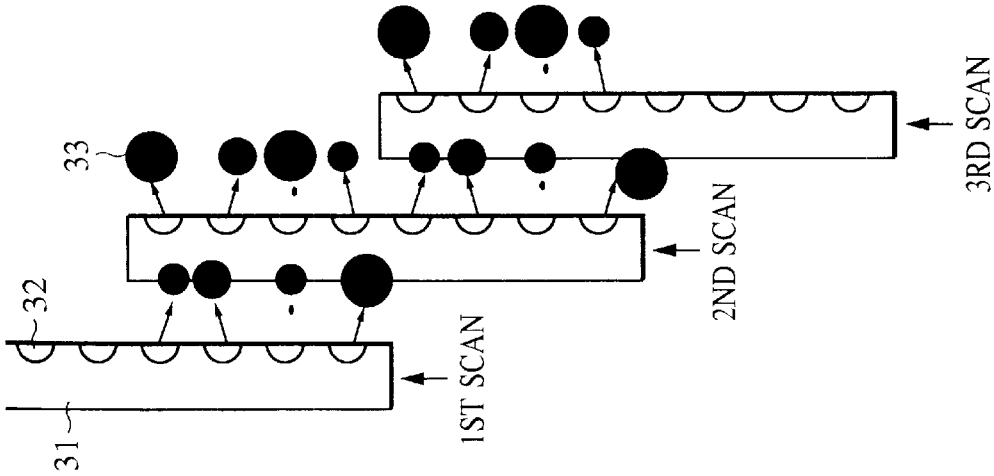
Figure 7:
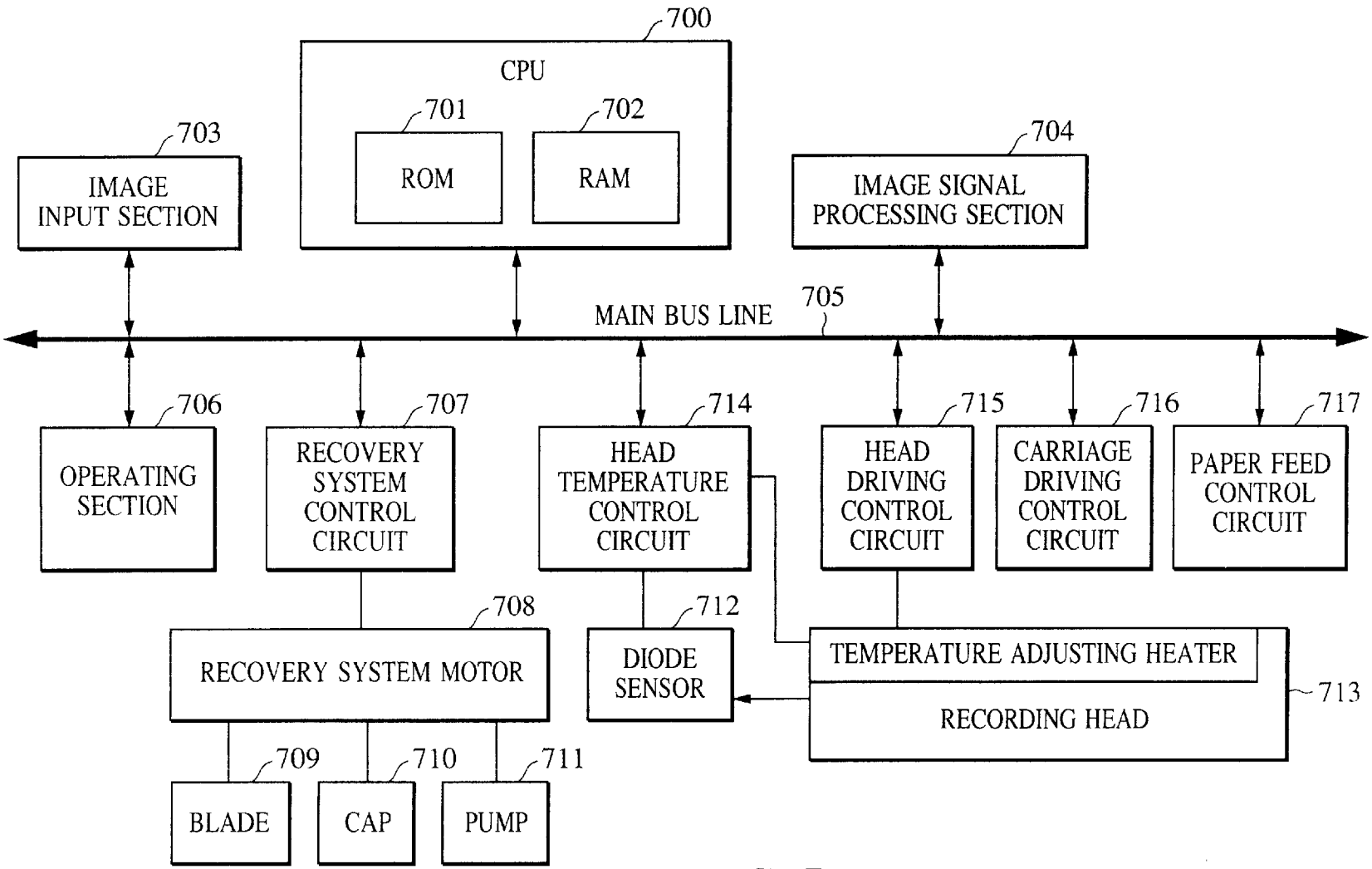
FIG. 7 is a block diagram illustrating a control configuration of the ink-jet recording apparatus of the present invention.

The overall configuration of the ink-jet recording apparatus of the present invention, common to the following embodiments, will be described first. FIG. 7 is a block diagram illustrating a control configuration of the ink-jet recording apparatus of the invention. This ink-jet recording apparatus has the same mechanical structure as that shown in FIG. 1.

The control configuration shown in FIG. 7 is broadly divided into a software processing means such as an image input section 703 accessing individual main bus lines 705, an image signal processing section 704 corresponding thereto, and a CPU 700 serving as a central control section, and a hardware processing means such as an operating section 706, a recovery system control circuit 707, an ink-jet head temperature control circuit 714, a head drive control circuit 715, a carriage drive control circuit 716 in the main scanning direction, and a paper feeding control circuit 717 in the sub-scanning direction.

The CPU 700 has a ROM 701 and a random memory (RAM) 702, and performs recording through driving of the recording head 713 by providing appropriate recording conditions to input information. A program executing head recovery processing was previously stored in the RAM 702, giving required recovery conditions, including preliminary discharge conditions, to the recovery system control circuit 707, the recording head, and an insulation heater. The recovery system motor 708 drives the above-mentioned recording head 713 and a cleaning blade 709 or a cap 710 and a suction pump 711 provided oppositely thereto. The head drive control circuit 715 executes driving conditions of the ink discharging electro-thermal converter of the recording head 713, and usually causes the recording head 713 to execute preliminary discharges or recording ink discharges.

On the other hand, the temperature adjusting heater is provided on a base plate having the ink discharging electro-thermal converter of the recording head 713 provided thereon, and can heat the ink in the recording head to a desired temperature and adjust it as necessary. A diode sensor 712 is similarly provided on the base plate for measuring the ink temperature in the recording head. The diode sensor 712 may as well be provided outside, not on the base plate, or in the proximity of the recording head.

Several embodiments of the present invention in the ink-jet recording apparatus having the above-mentioned configuration will now be described.

[First Embodiment]

A first embodiment of the present invention will now be described with reference to FIGS. 8 to 16. This embodiment covers a case where a color image is recorded with a single recording head.

In this embodiment, a recording head having 16 discharge ports (nozzles) at a pitch of 600 dpi is used. Color ink having an absorption coefficient Ka of 7.0 (ml·m−2·msec−½) in the Bristow method, known as a method for evaluating penetrability for a short period, is used when using ordinary paper (made by Canon Inc., SUPER WHITE PAPER SW-101 or the like) as a recording medium. In this embodiment, a complete recording is executed by selecting either two or four scanning runs. The scanning direction is reverse between an odd number and an even number run of scanning. A manner of recording known as the two-way recording occurs when an even number run of scanning is started in the reverse direction at a position where an odd number run of scanning is finished.

Figure 8:
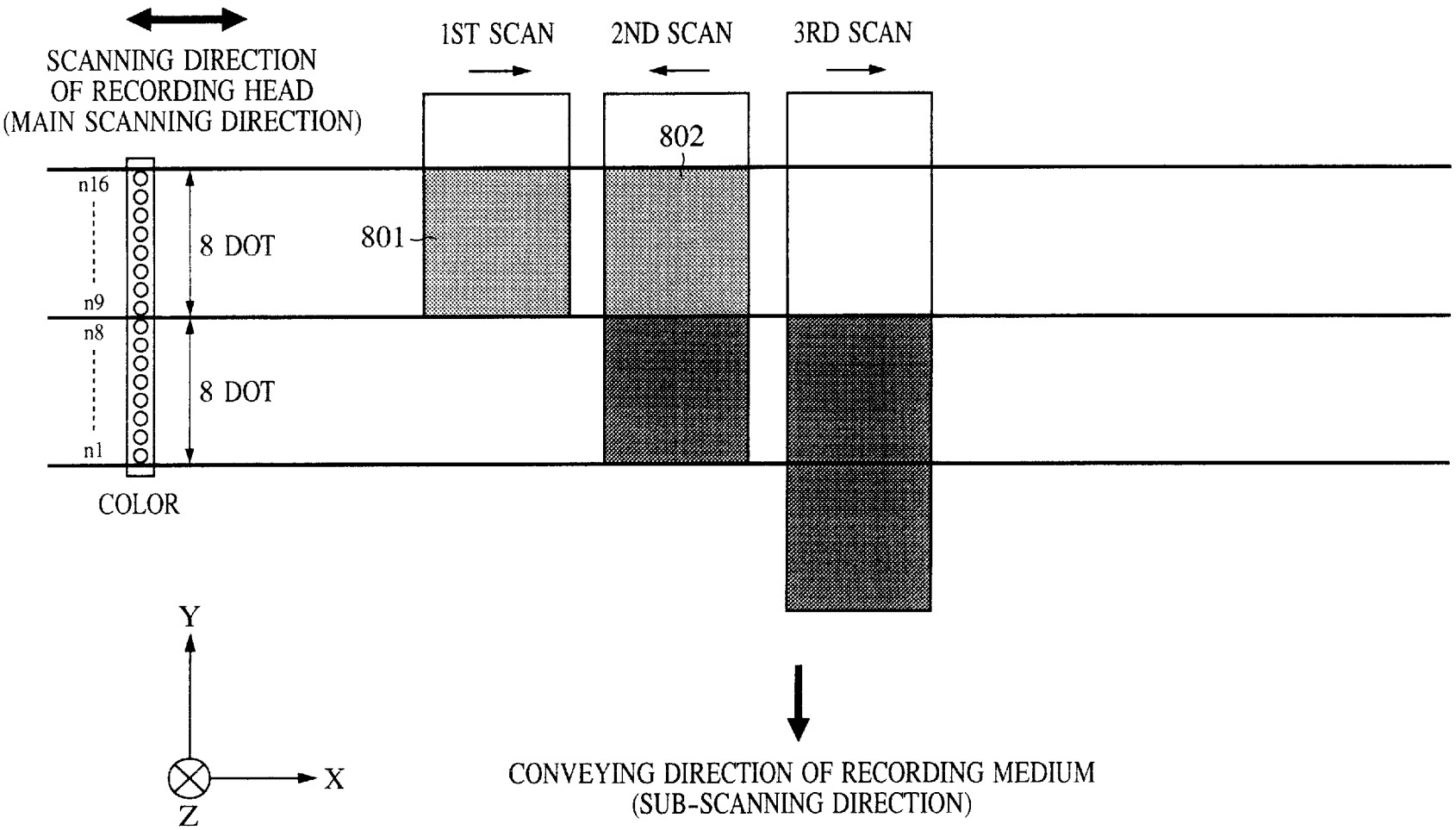
FIG. 8 illustrates the two-pass recording method in a first embodiment of the invention.
Figure 10:
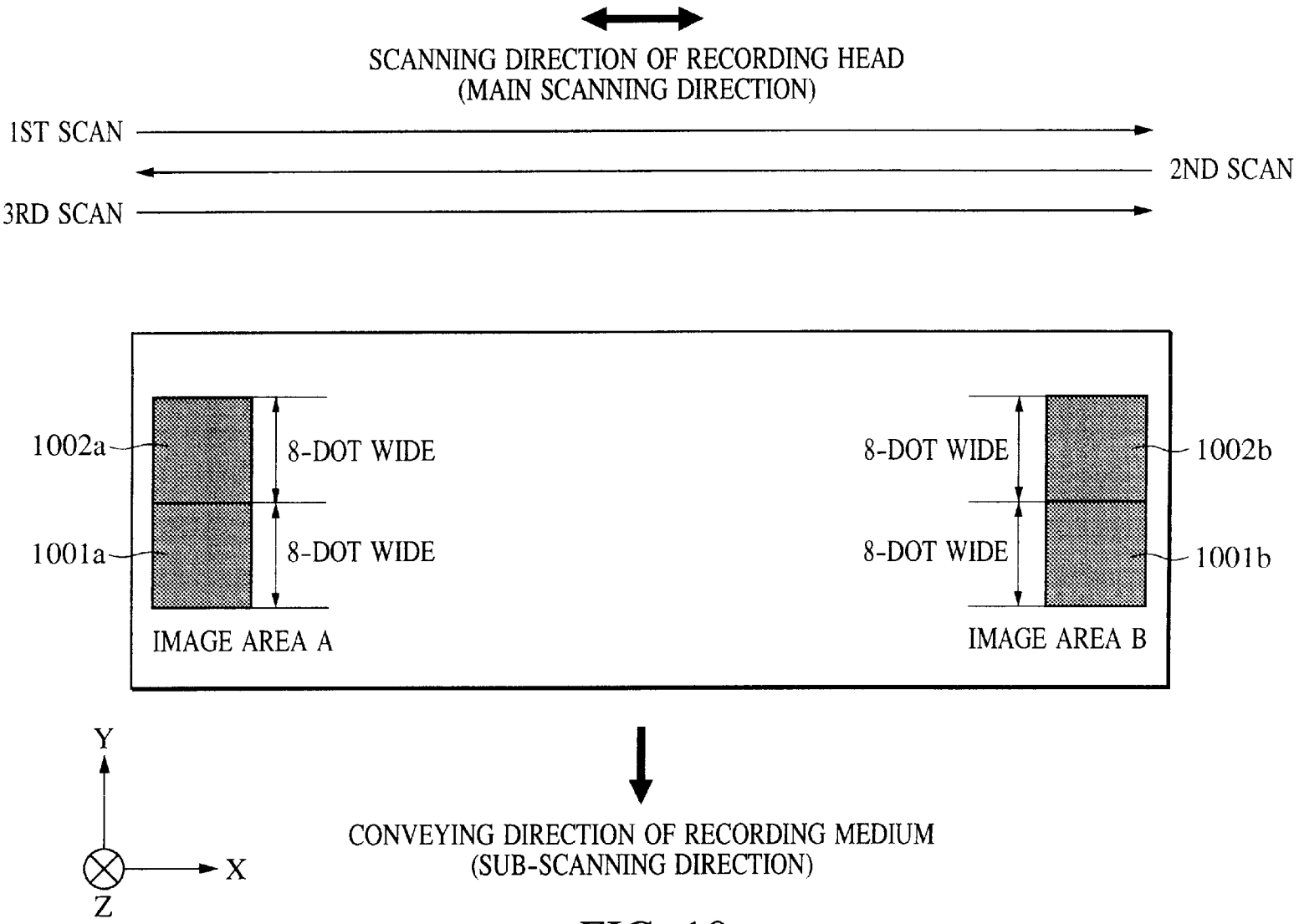
FIG. 10 illustrates the position of a two-pass recording area in the first embodiment of the invention.

A case where image recording for each area is completed with two runs of scanning, and recording is discontinued for 1.5 seconds after each run of scanning will first be described with reference to FIGS. 8, 10, 12, and 14. FIG. 8 illustrates the relationship between the recording head and recording of each run of scanning. FIG. 10 shows both ends of an area recorded in each run of scanning, for example, the both end portions of an A4-sized recording medium. FIG. 13 illustrates the relationship between the recording time and the rest period for each image area. FIGS. 14A and 14B show printed patterns used in the individual runs of scanning: the pattern of FIG. 14A is used in the odd number runs and the pattern of FIG. 14B is used in the even number runs.

In the first run of scanning, the area represented by 801 in FIG. 8 is recorded by use of eight nozzles n9 to n16 from among the 16 nozzles of the recording head, and the printed pattern of FIG. 14A. This area corresponds to 1001*a* and 1001*b* in FIG. 10. Since the scanning direction is from left to right in the drawing, the area 1001*b* is recorded after recording the area 1001*a*. Then, recording is discontinued for 1.5 seconds as a rest period.

After the rest period, the recording medium is conveyed in the sub-scanning direction by a paper feeding motor by 8/600 inches (distance corresponding to eight nozzles). Thereafter, in the second run of scanning, recording is performed in a sequence from 1001*b* to 1001*a* in FIG. 10 in an area represented by 801 in FIG. 8 by use of the printed pattern shown in FIG. 14B with eight nozzles n1 to n8 from among the 16 nozzles in a direction reverse to that in the first run of scanning. At this point in time, an area indicated by 802 in FIG. 8 is recorded in a sequence from 1002*b* to 1002*a* shown in FIG. 10, by means of the printed pattern shown in FIG. 14A with eight nozzles n9 to n16. Then, recording is discontinued for 1.5 seconds as a rest period.

Recording of the image area A (1001*a*) through the first and second runs of scanning requires a time of 1.85 seconds, as shown in FIG. 12, as calculated by adding a rest period of T=1.5 seconds to the time required for record-scanning of T1=0.35 seconds. Recording of the image area B (1001*b*) requires a time of 1.65 seconds as obtained by adding a rest period of T=1.5 seconds to the time required for record-scanning of T2=0.15 seconds.

Then, after the rest period, the recording medium is conveyed in the sub-scanning direction by means of the paper feeding motor by 8/600 inches. Subsequently, in the third run of scanning, an area indicated by 802 in FIG. 8 is recorded in a sequence from 1002*a* to 1002*b* in FIG. 10 by use of the printed pattern shown in FIG. 14B with eight nozzles n1 to n8 from among the 16 nozzles in the same direction as in the first run of scanning.

Recording of the image area A (1002*a*) through the second and third runs of scanning requires a time of 1.65 seconds, as shown in FIG. 12, as calculated by adding a rest period T=1.5 seconds to the time required for record scanning of T2=0.15 seconds. Recording of an image area B (1002*b*) requires a time of 1.85 seconds as obtained by adding a rest period of T=1.5 seconds to the time required for record-scanning of T1=0.35 seconds.

As described above, when the image for each area is completed in two runs of scanning, and a rest period of 1.5 seconds is provided after each run of scanning, the time up to the completion of recording for each area is 1.85 seconds for the area 1001*a*, 1.65 seconds for the area 1002*a*, 1.65 seconds for the area 1001*b*, and 1.85 seconds for the area 1002*b*, and a time sufficient for the ink to penetrate into the recording medium and to be fixed there is ensured during the time from the first run of scanning to the second run of scanning for each area. As a result of recording as described above, color unevenness and density irregularity were reduced as compared to a case without a rest period, without production of paper surface staining caused by cockling, thus enabling the apparatus to record a high-quality image.

Figure 9:
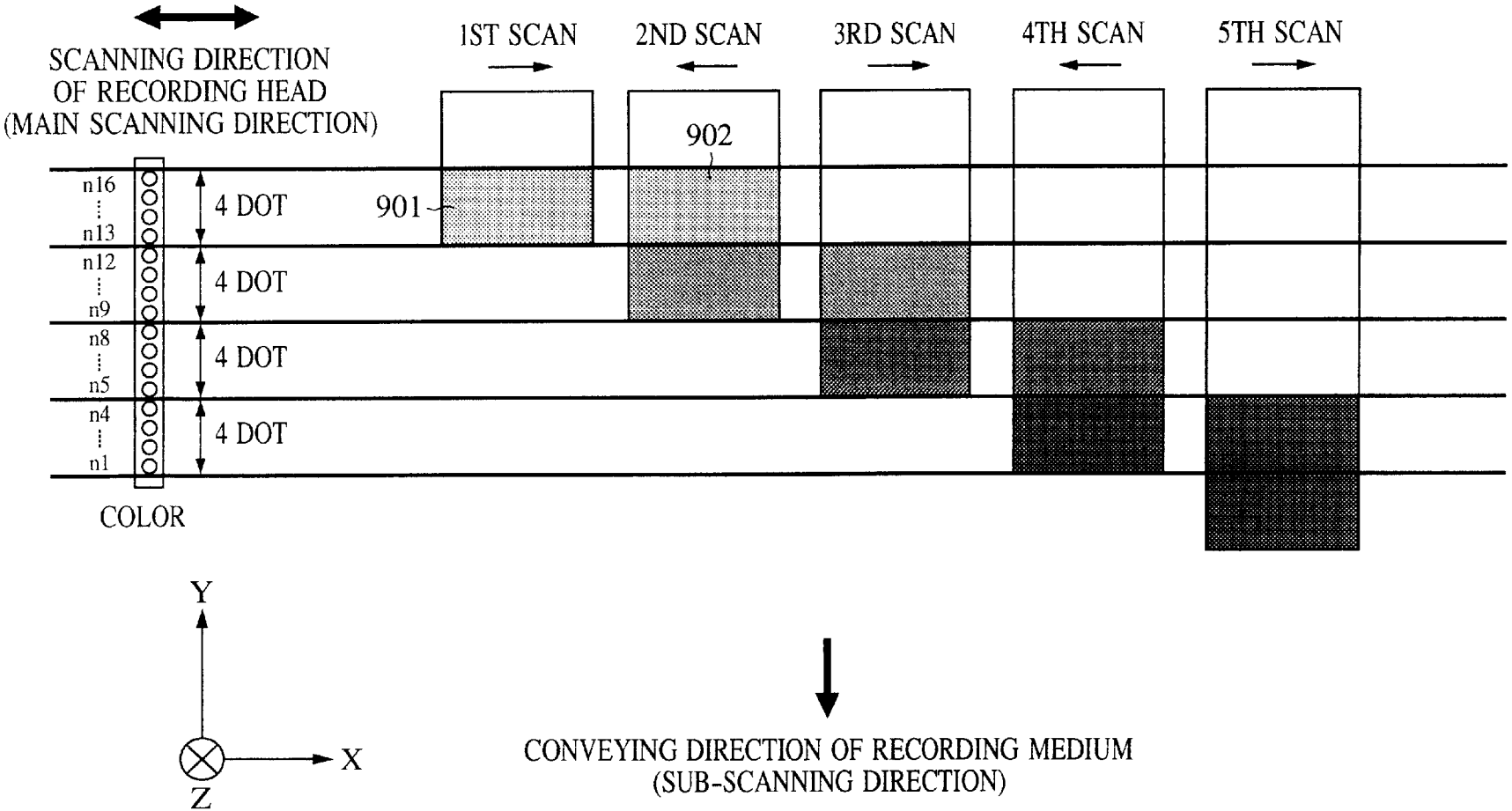
FIG. 9 illustrates the four-pass recording method in the first embodiment of the invention.
Figure 11:
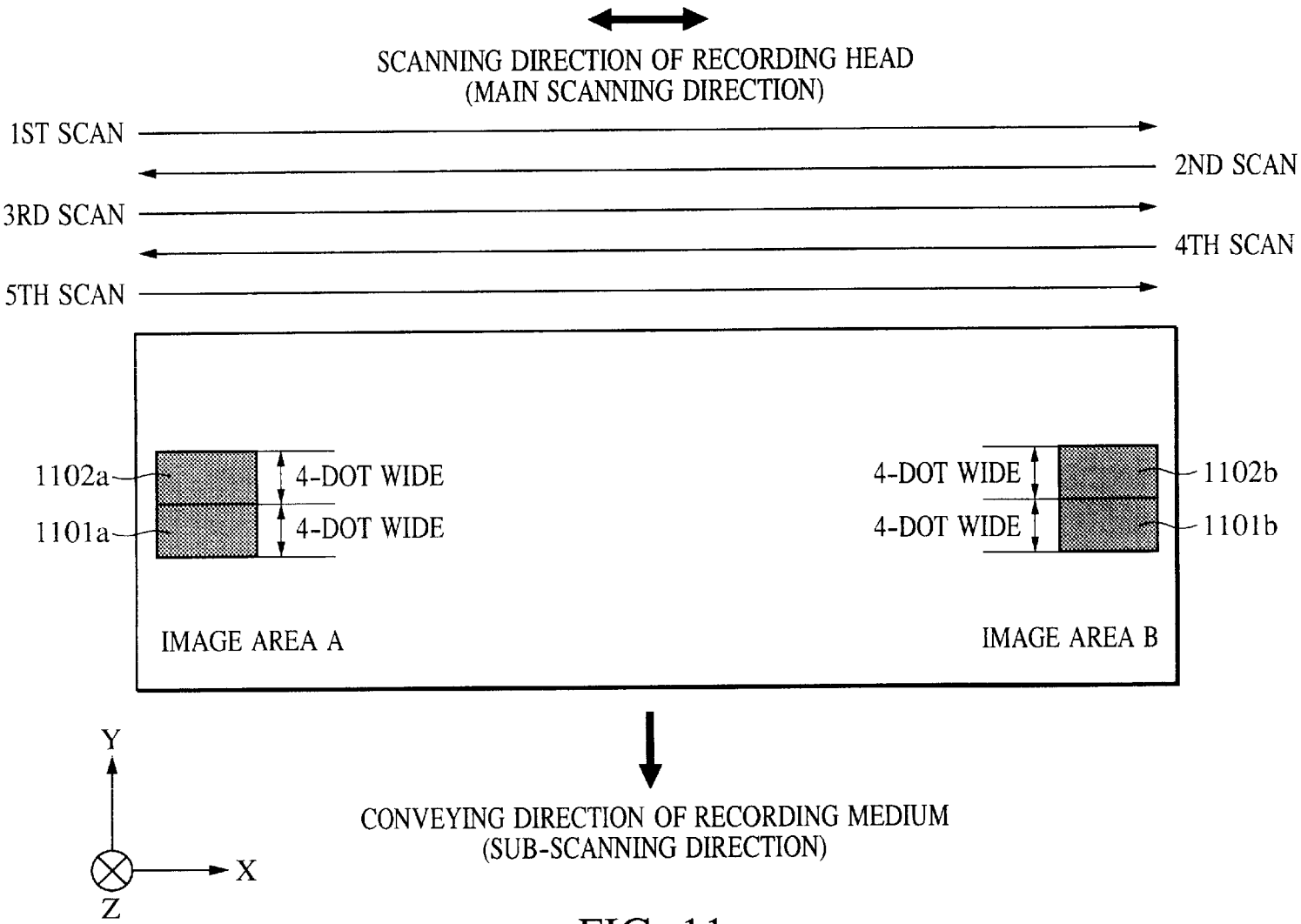
FIG. 11 illustrates the position of a four-pass recording area in the first embodiment of the invention.

A case where image recording for each area is completed with four runs of scanning, and recording is discontinued for 0.5 seconds after each run of scanning will now be described with reference to FIGS. 9, 11, 13 and 15. FIG. 9 illustrates the relationship between the recording head and recording of each run of scanning. FIG. 11 shows both ends of an area recorded in each run of scanning, for example, the both end portions of an A4-sized recording medium. FIG. 13 illustrates the relationship between the recording time and the rest period for each image area. FIG. 15 shows printed patterns used in the individual runs of scanning: each of the patterns shown in FIGS. 15A to 15D is used in each of the first to fourth runs of scanning in each area.

In the first run of scanning, an area represented by 901 in FIG. 9 is recorded by use of four nozzles n13 to n16 from among the 16 nozzles and the printed pattern of FIG. 15A in a sequence from 1101*a* to 1101*b* shown in FIG. 11. Then, recording is discontinued for 0.5 seconds.

After the rest period, the recording medium is conveyed in the sub-scanning direction by a paper feeding motor by 4/600 inches (distance corresponding to four nozzles).

Thereafter, in the second run of scanning, recording is performed in a sequence from 1101*b* to 1101*a* in an area represented by 901 in FIG. 9 by use of the printed pattern shown in FIG. 15B with four nozzles n9 to n12 in a direction reverse to that in the first run of scanning. At this point in time, an area indicated by 902 in FIG. 9 is recorded in a sequence from 1102*b* to 1102*a* shown in FIG. 11, by means of the printed pattern shown in FIG. 15A with four nozzles n13 to n16 from among the 16 nozzles. Then, recording is discontinued for 0.5 seconds as a rest period.

Recording of the image area A (1101*a*) through the first and second runs of scanning requires a time of 0.85 seconds, as calculated by adding a rest period of T=0.5 seconds to the time required for record scanning of T1=0.35 seconds. Recording of the image area B (1101*b*) requires a time of 0.65 seconds as obtained by adding a rest period of T=0.5 seconds to the time required for record scanning of T2=0.15 seconds.

Then, the recording medium is conveyed in the sub-scanning direction by means of the paper feeding motor by 4/600 inches. Subsequently, in the third run of scanning, an area indicated by 901 in FIG. 9 is recorded in a sequence from 1101*a* to 1101*b* in FIG. 11 by use of the printed pattern shown in FIG. 15C with four nozzles Nos. 5 to 8 from among the 16 nozzles in the same direction as in the first run of scanning. Simultaneously, an area indicated by 902 in FIG. 9 is recorded in a sequence from 1102*a* to 1102*b* shown in FIG. 11, by means of the printed pattern shown in FIG. 15B with four nozzles n9 to n12. Then, recording is discontinued for 0.5 seconds as a rest period.

Recording of the image area A (1101*a* and 1102*a*) through the second and third runs of scanning requires a time of 0.65 seconds, as calculated by adding a rest period of T=0.5 seconds to the time required for record scanning of T2=0.15 seconds. Recording of the image area B (1101*b* and 1102*b*) requires a time of 0.85 seconds, as obtained by adding a rest period of T=0.5 seconds to the time required for record scanning of T1=0.35 seconds.

Then, the recording medium is conveyed in the sub-scanning direction by means of the paper feeding motor of 4/600 inches. Subsequently, in the fourth run of scanning, an area indicated by 901 in FIG. 9 is recorded in a sequence from 1101*b* to 1101*a* in FIG. 11 by use of the printed pattern shown in FIG. 15D with four nozzles n1 to n4 from among the 16 nozzles in the same direction as in the second run of scanning. Simultaneously, an area indicated by 902 in FIG. 9 is recorded in a sequence from 1102*b* to 1102*a* shown in FIG. 11, by means of the printed pattern shown in FIG. 15C with four nozzles n5 to n8. Then, recording is discontinued for 0.5 seconds as a rest period.

Recording of the image area A (1101*a* and 1102*a*) through the third and fourth runs of scanning requires a time of 0.85 seconds, as calculated by adding a rest period of T=0.5 seconds to the time required for record scanning of T1=0.35 seconds. Recording of the image area B (1101*b* and 1102*b*) requires a time of 0.65 seconds as obtained by adding a rest period of T=0.5 seconds to the time required for record scanning of T2=0.15 seconds.

Then, the recording medium is conveyed in the sub-scanning direction by means of the paper feeding motor by 4/600 inches. Subsequently, in the fifth run of scanning, an area indicated by 902 in FIG. 9 is recorded in a sequence from 1102*a* to 1102*b* in FIG. 11 by use of the printed pattern shown in FIG. 15D with four nozzles n1 to n4 from among the 16 nozzles in the same direction as in the first and third runs of scanning.

Recording of the image area A (1102*a*) through the fourth and fifth runs of scanning requires a time of 0.65 seconds, as calculated by adding a rest period of T=0.5 seconds to the time required for record scanning of T2=0.15 seconds. Recording of the image area B (1102*b*) requires a time of 0.85 seconds as obtained by adding a rest period of T=0.5 seconds to the time required for record scanning of T1=0.35 seconds.

As described above, when the image is completed in each area with four runs of scanning, and a rest period of 0.5 seconds is provided after each run of scanning, the time required for completing recording in the individual areas is, in the area 1101*a*, 0.85+0.65+0.85=2.35 seconds; in the area 1102*a*, 0.65+0.85+0.65=2.15 seconds; in the area 1101*b*, 0.65+0.85+0.65=2.15 seconds; and in the area 1102*b*, 0.85+0.65+0.85=2.35 seconds. A time sufficient for the ink to penetrate into the recording medium and to be fixed there is ensured before starting the next run of scanning in each area. As a result of recording in the manner as described above, color unevenness and density irregularity are reduced as compared with the case where a rest period is not provided, without occurrence of paper surface staining caused by cockling, thus achieving recording of a high-quality image.

Regarding the two-pass recording, which records an image through two runs of scanning, and the four-pass recording, which records an image through four runs of scanning, as described above, the rest period for discontinuing recording for each run of scanning was changed to various levels to evaluate color unevenness, density irregularity and paper surface staining caused by cockling. The results are shown in FIG. 16.

As shown in FIG. 16, a longer rest period brought about a better result in terms of color unevenness and density irregularity, whereas a shorter rest period corresponded to a better result in terms of paper surface staining. When carrying out more runs of scanning, the setting of a shorter rest period than in a case with a fewer runs of scanning was more effective for preventing color unevenness, density irregularity and paper surface staining.

In this embodiment, a case where color recording is performed with a single recording head has been described. Similar advantages are available when conducting recording by using a plurality of heads. Because the extent of density irregularity and color unevenness differs with the chemical composition of the recording medium or the ink used, the user may be permitted to select whether or not a rest period is to be provided on, for example, the utility screen of the printer driver upon performing recording, or to select one from a plurality of times including 0 for the rest period.

According to this embodiment, by conducting rest period timing control as described above, it is possible to ensure a time for ink penetration and fixing into the recording medium in response to the number of passes in the multi-pass recording method, prevent density irregularity and color unevenness, and prevent staining of the recording medium caused by contact between the recording head and the recording medium, thereby recording a high-quality image.

[Second Embodiment]

A second embodiment of the present invention will now be described. In the following paragraphs, the description will be omitted for portions similar to those described in the above-mentioned first embodiment, and the description will center around the characteristics to this embodiment.

In this embodiment, an image is recorded by use of two recording heads including a recording head discharging high-penetrability color ink and another recording head discharging low-penetrability black ink. Each of the recording heads discharging the color ink and the recording heads discharging the black ink has 16 discharge ports (nozzles) each at a density of 600 dpi. The Ka value in the Bristow method of the color ink and the black ink is 7.0 (ml·m−2·msec−½) and 1.0 (ml·m−2msec−½), respectively, when using ordinary paper (made by Canon Inc., SUPER WHITE PAPER SW-101 or the like): the black ink is lower in penetrability than the color ink.

The color ink and the black ink should preferably be selected so that the color ink is higher in penetrability than the black ink. In an ink-jet recording apparatus, colors other than black are expressed by color mixtures using kinds of ink such as YMC. In areas recorded with color ink, therefore, problems of density irregularity, color unevenness and blotting between kinds of ink may be posed.

In this embodiment, as in the first embodiment, in order to complete recording of areas, recording is executed by selecting a number of runs (passes) of scanning from two and four. The scanning direction is reversed between an odd number run and an even number run of scanning: an even number run of scanning is started at the ending position of an odd number run of scanning, as in the manner known as the two-way recording.

Figure 17:
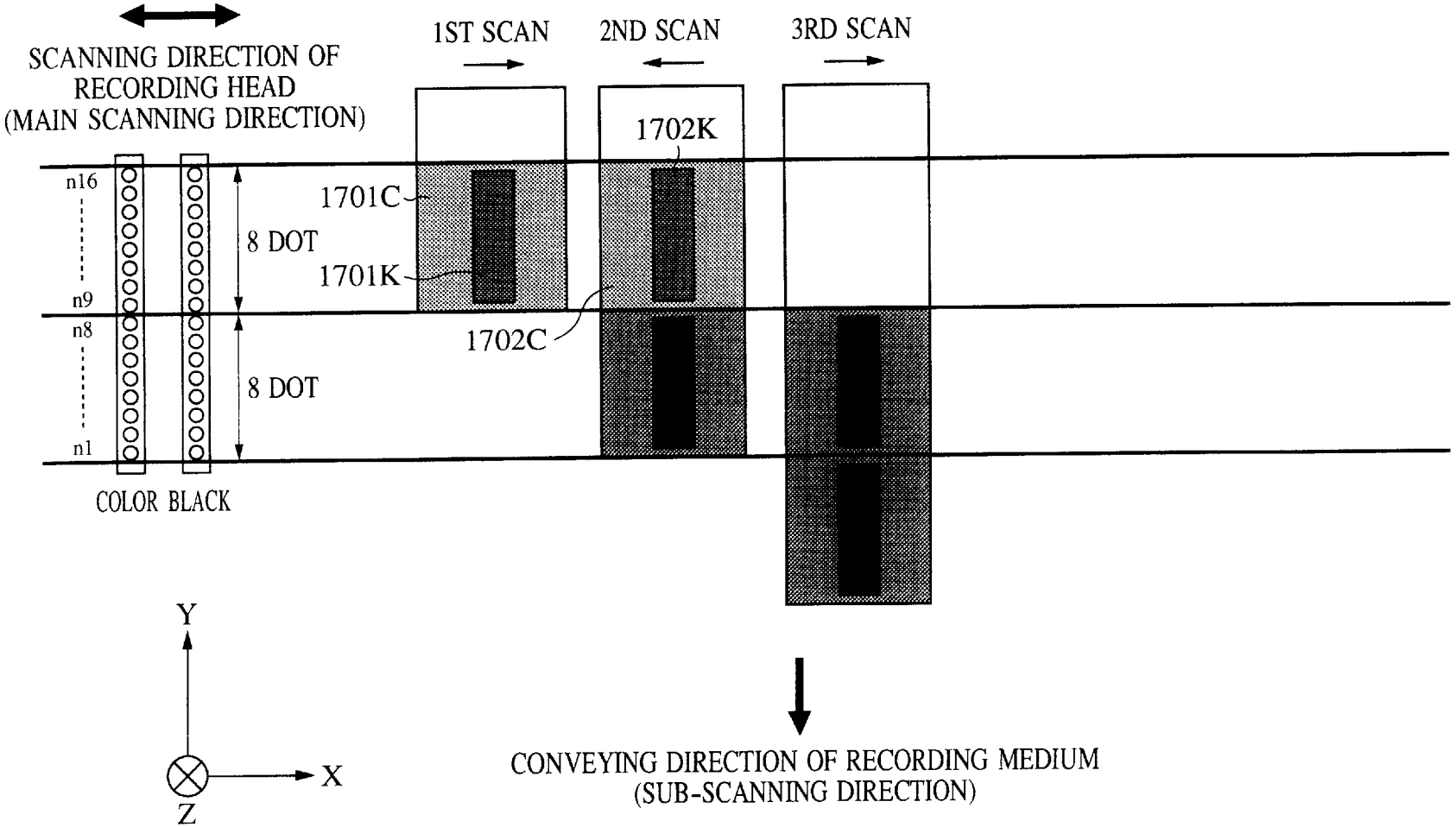
FIG. 17 illustrates the two-pass recording method in a second embodiment of the invention.
Figure 19:
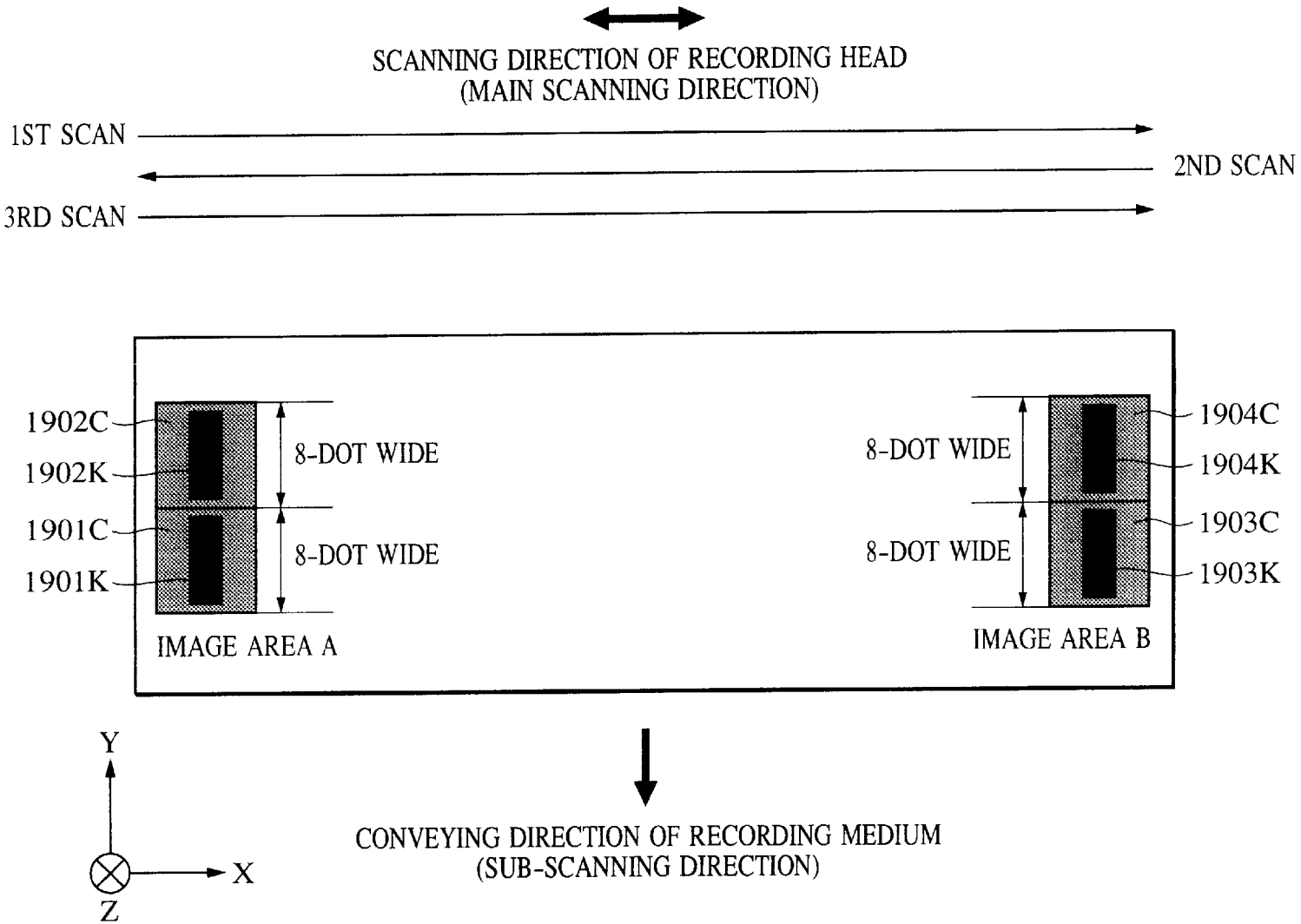
FIG. 19 illustrates the position of a two-pass recording area in the second embodiment of the invention.

A case where image recording for each area is completed by two runs of scanning and recording is discontinued for 1.5 seconds after each run of scanning will be described with reference to FIGS. 17, 19, 12, and 14. FIG. 17 illustrates the relationship between the recording head and recording in each run of scanning. FIG. 19 shows both ends of an area recorded in each run of scanning, for example, the both end portions of an A4-sized recording medium. The relationship between the recording time and the rest period for each image area is the same as that shown in FIG. 12 described above in relation to the first embodiment. The printed pattern shown in FIG. 14A (described above) as to the first embodiment is used in odd number runs of scanning, and the pattern shown in FIG. 14B is used in even number runs of scanning.

An area recorded only with the black ink and an area recorded only with the color ink is provided in this embodiment, and blotting on the boundary between the two areas is evaluated.

Areas indicated by 1701C and 1701K in FIG. 17 are recorded with the color recording head and the black recording head, respectively, by use of the pattern shown in FIG. 14A with eight nozzles n9 to n16 from among the 16 nozzles of the recording head in the first run of scanning. These areas correspond to 1901C, 1901K, 1903C and 1903K in FIG. 19. Since the scanning direction is from left to right in the drawing, the areas 1903C and 1903K are recorded after recording the areas 1901C and 1901K. Recording is then discontinued for 1.5 seconds as a rest period.

After the rest period, the recording medium is conveyed in the sub-scanning direction by means of a paper feeding motor by 8/600 inches. Thereafter, in the second run of scanning, areas indicated by 1701C and 1701K in FIG. 17 are recorded in a sequence from 1903C and 1903K to 1901C and 1901K*a*, by means of the printed pattern shown in FIG. 14B with eight nozzles n1 to n8 from among the 16 nozzles in a direction reverse to that in the first run of scanning. Simultaneously, the areas indicated by 1702C and 1702K in FIG. 17 are recorded in a sequence from 1904C and 1904K to 1902C and 1902K in FIG. 19 by use of the printed pattern of FIG. 14A with eight nozzles Nos. 9 to 16. Then, recording is discontinued for 1.5 seconds as a rest period.

Recording of the image area A (1901C and 1901K) through the first and second runs of scanning requires a time of 1.85 seconds, as shown in FIG. 12, as calculated by adding a rest period of T=1.5 seconds to the time of T1=0.35 seconds required for record scanning. Recording of the image area B (1903C and 1903K) requires a time of 1.65 seconds as obtained by adding a rest period of T=1.5 seconds to the time of T2=0.15 seconds required for record scanning.

After the rest period, the recording medium is conveyed in the sub-scanning direction by means of the paper feeding motor by 8/600 inches. Thereafter, in the third scanning, areas indicated by 1702C and 1702K in FIG. 17 are recorded in a sequence from 1902C and 1902K to 1903C and 1904K in FIG. 19 by use of the printed pattern shown in FIG. 14B with eight nozzles n1 to n8 from among the 16 nozzles in the same direction as in the first run of scanning.

Recording of the image area A (1902C and 1902K) through the second and third runs of scanning requires a time of 1.65, as shown in FIG. 12, as calculated by adding the rest period of T=1.5 seconds to the time of T2=0.15 required for record scanning. Recording of the image area B (1904C and 1904K) requires a time of 1.85 seconds as obtained by adding the rest period of T=1.5 seconds to the time of T1=0.35 seconds required for record scanning.

When an image for each area is completed through two runs of scanning and a rest period of 1.5 seconds is provided after each run of scanning as described above, the time up to the completion of recording for each area is 1.85 seconds for areas 1901C and 1901K, 1.65 seconds for areas 1902C and 1902K, 1.65 seconds for areas 1903C and 1903K, and 1.85 seconds for areas 1904C and 1904K. A time sufficient to allow the ink to penetrate into the recording medium and to be fixed there is ensured. As a result of recording as described above, color unevenness and density irregularity were reduced as compared with the case where no rest period was provided, without occurrence of paper surface stain caused by cockling, and blotting in the boundary between the portion recorded with the black ink and the portion recorded with the color ink was prevented, thus resulting a high-quality image.

Figure 18:
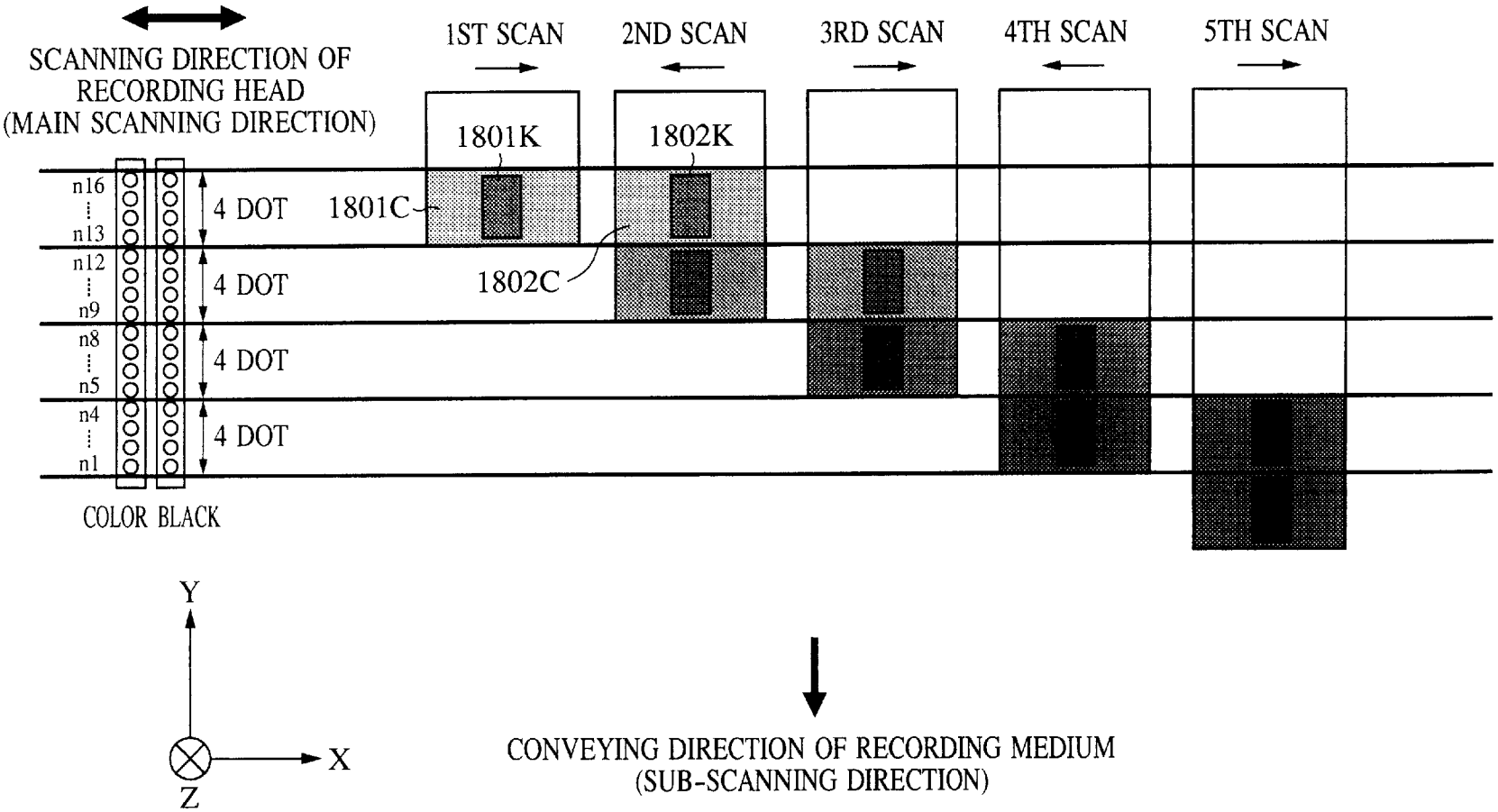
FIG. 18 illustrates the four-pass recording method in the second embodiment of the invention.
Figure 20:
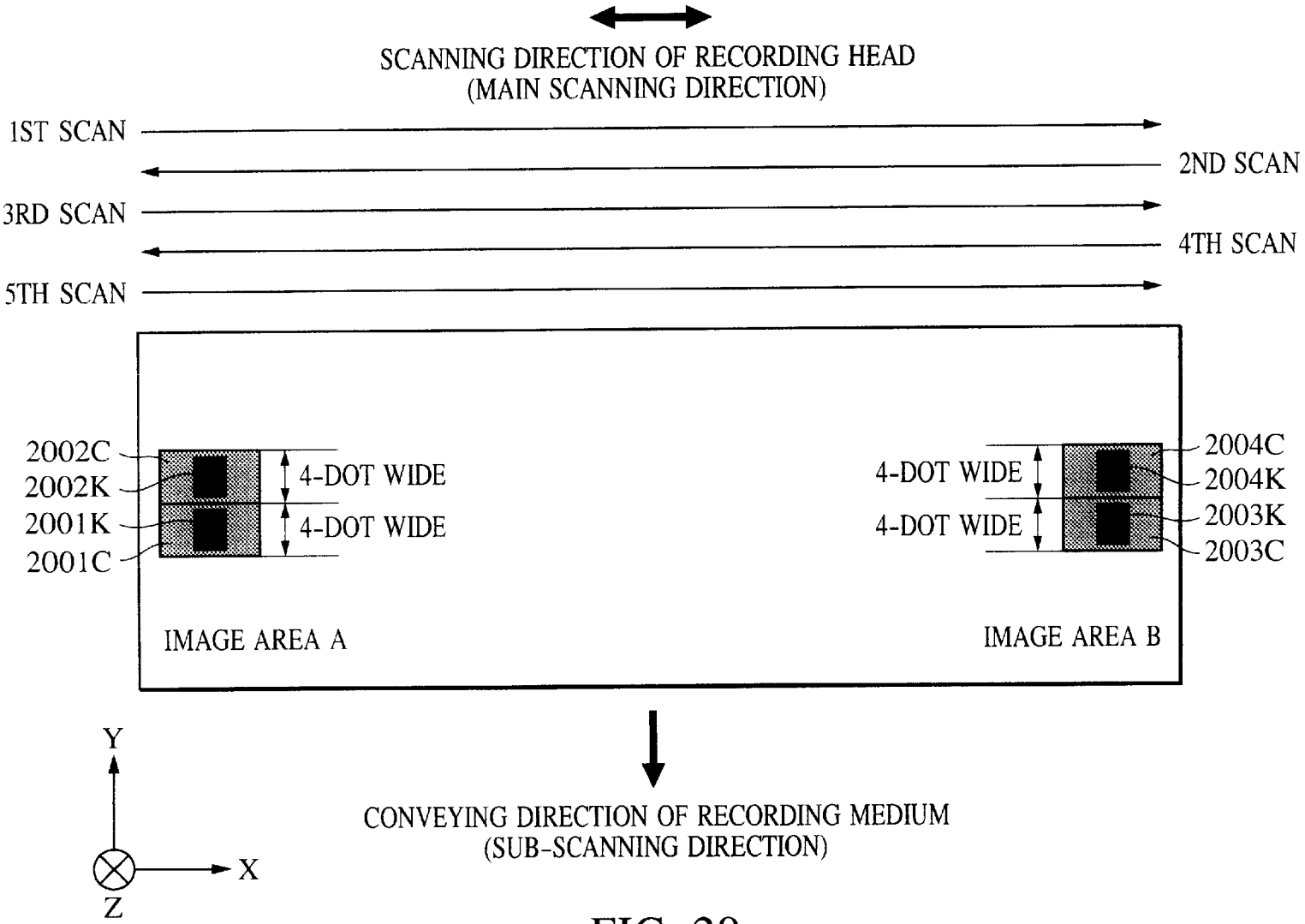
FIG. 20 illustrates the position of a four-pass recording area in the second embodiment of the invention.

A case where image recording in each area is completed through four runs of scanning, and recording is discontinued for 0.5 seconds after each run of scanning will now be described with reference to FIGS. 18, 20, 13, and 15. FIG. 18 illustrates the relationship between the recording head and recording in each run of scanning. FIG. 20 shows both ends of an area recorded in each run of scanning, for example the both end portions of an A4-sized recording medium. The relationship between the recording time and the rest period for each image area is the same as that shown in FIG. 13 (described above) as to the first embodiment. The printed patterns used in the first to fourth runs of scanning for each area are the patterns shown in FIGS. 15A to 15D (described above) as to the first embodiment.

The areas indicated by 1801C and 1801K in FIG. 18 are recorded in a sequence from 2001C and 2001K to 2003C and 2003K shown in FIG. 20, by use of the printed pattern shown in FIG. 15A with four nozzles n13 to n16 from among the 16 nozzles in the first run of scanning. Then, recording is discontinued for 0.5 seconds.

After the rest period, the recording medium is conveyed in the sub-scanning direction by means of the paper feeding motor by 4/600 inches. Thereafter, in the second run of scanning, the areas indicated by 1801C and 1801K are recorded in a sequence from 2003C and 2003K to 2001C and 2001K shown in FIG. 20 by use of the printed pattern shown in FIG. 15B with four nozzles n9 to n12 in a direction reverse to that in the first run of scanning. Simultaneously, the areas indicated by 1802C and 1802K in FIG. 18 are recorded in a sequence from 2004C and 2004K to 2002C and 2002K as shown in FIG. 20 by use of the printed pattern of FIG. 15A with four nozzles n13 to n16 from among the 16 nozzles. Then, recording is discontinued for 0.5 seconds as a rest period.

Recording of the image area A (2001C and 2001K) through the first and second runs of scanning requires 0.85 seconds, as calculated by adding the rest period of T=0.5 seconds to the time of T1=0.35 seconds required for record scanning. Recording of the image area B (2003C and 2003K) required a time of 0.65 seconds, as obtained by adding the rest period of T=0.5 seconds to the time of T2=0.15 seconds required for record scanning.

Then, the recording medium is conveyed in the sub-scanning direction by means of the paper feeding motor by 4/600 inches. Subsequently, in the third run of scanning, the areas indicated by 1801C and 1801K in FIG. 18 are recorded in a sequence from 2001C and 2001K to 2003C and 2003K shown in FIG. 20 by use of the printed pattern shown in FIG. 15C with four nozzles n5 to n8 from among the 16 nozzles, in the same direction as in the first run of scanning. Simultaneously, the areas indicated by 1802C and 1802K in FIG. 18 are recorded in a sequence from 2002C and 2002K to 2004C and 2004K shown in FIG. 20 by use of the printed pattern of FIG. 15B with four nozzles n9 to n12. Then, recording is discontinued for 0.5 seconds as a rest period.

Recording of the image area A (2001C, 2001K, 2002C and 2002K) through the second and third runs of scanning requires a time of 0.65 seconds, as calculated by adding the rest period of T=0.5 seconds to the time of T2=0.15 seconds required for record scanning. Recording of the image area B (2003C, 2003K, 2004C and 2004K) requires a time of 0.85 seconds, obtained by adding the rest period of T=0.5 seconds to the time of T1=0.35 seconds required for record scanning.

Then, the recording medium is conveyed in the sub-scanning direction by means of the paper feeding motor by 4/600 inches. Thereafter, in the fourth run of scanning, the areas indicated by 1801C and 1801K in FIG. 18 are recorded in a sequence from 2003C and 2003K to 2001C and 2001K shown in FIG. 20, by use of the printed pattern of FIG. 15D with four nozzles n1 to n4 from among the 16 nozzles. Simultaneously, the areas indicated by 1802C and 1802K in FIG. 18 are recorded in a sequence from 2004C and 2004K to 2002C and 2002K by use of the printed pattern of FIG. 15C with four nozzles Nos. 5 to 8. Then, recording is discontinued for 0.5 seconds as a rest period.

Recording of the image area (2001C, 2001K, 2002C and 2002K) through the third and fourth runs of scanning requires a time of 0.85 seconds, as calculated by adding the rest period of T=0.5 seconds to the time of T1=0.35 seconds required for record scanning. Recording of the image area B (2003C, 2003K, 2004C and 2004K) requires a time of 0.65 seconds, as obtained by adding the rest period of T=0.5 seconds to the time of T2=0.15 seconds required for record scanning.

Then, the recording medium is conveyed in the sub-scanning direction by means of the paper feeding motor by 4/600 inches. Thereafter in the fifth run of scanning, the areas indicated by 1802C and 1802K in FIG. 18 are recorded in a sequence from 2004C and 2004K to 2002C and 2002K shown in FIG. 20 by use of the printed pattern of FIG. 15D with four nozzles n1 to n4 from among the 16 nozzles in the same direction as in the first and third runs of scanning.

Recording of the image area A (2002C and 2002K) through the fourth and fifth runs of scanning requires a time of 0.65 seconds, as calculated by adding the rest period of T=0.5 seconds to the time of T2=0.15 seconds required for record scanning. Recording of the image area B (2004C and 2004K) requires a time of 0.85 seconds, as obtained by adding the rest period of T=0.5 seconds to the time T1=0.35 seconds required for record scanning.

As described above, when an image in each area is completed through four runs of scanning, and a rest period of 0.5 seconds is provided after each run of scanning, the time required before completion of the recording for the individual areas is 0.85+0.65+0.85=2.35 seconds for the areas 2001C and 2001K; 0.65+0.85+0.65=2.15 seconds for the areas 2002C and 2002K; 0.65+0.85+0.65=2.15 seconds for the areas 2003C and 2003K, and 0.85+0.65+0.85=2.35 seconds for the areas 2004; and 2004K. A time sufficient for the ink to penetrate into the recording medium, and to be fixed thereto, is ensured before starting the next run of scanning for the individual areas. As a result of recording as described above, color unevenness and density irregularity were reduced as compared to the case where a rest period was not provided, without occurrence of paper surface stain caused by cockling, and blotting in the boundary between the portion recorded with the black ink and the portion recorded with the color ink was prevented, thus resulting in a high-quality image.

As to the two-pass recording, in which an image is recorded in two runs of scanning by use of two recording heads for black ink and color ink, and the four-pass recording, in which an image is recorded in four runs of scanning, the rest period, during which recording is discontinued after each run of scanning, was varied to various levels to evaluate color unevenness, density irregularity, paper surface staining caused by cockling, and blotting on the boundary between the area recorded with color ink and the area recorded with black ink. The results are shown in FIG. 21.

As shown in FIG. 21, a longer rest period brought about a better result in terms of color unevenness and density irregularity, whereas a shorter rest period corresponded to a better result in terms of paper surface staining. For blotting on the boundary, a better result was obtained with a longer rest period. When carrying out more runs of scanning, setting of a shorter rest period, as compared to a case with a fewer runs of scanning, was more effective for preventing of color unevenness, density irregularity, paper surface staining and blotting on the boundary.

In this embodiment, a case where a color ink recording head and a black ink recording head are used has been described as an example. Similar advantages are available when conducting recording by use of four different recording heads for cyan, magenta, yellow, and black ink. The mechanical configuration of a plurality of recording heads, not arranged in the transverse direction as in this embodiment, but in the longitudinal arrangement in which a plurality of recording heads are arranged along straight line in the conveying direction of the recording medium, can provide similar advantages.

Because the extent of density irregularity, color unevenness and blot on the black-color boundary differs with the chemical composition of the recording medium or the type of ink used, the user may be permitted to select whether or not a rest period is to be provided on, for example, the utility screen of the printer driver upon performing recording, or to select one from a plurality of times including 0 for the rest period.

According to this embodiment, by conducting rest period time control as described above, it is possible to ensure a time for ink penetration and fixing into the recording medium in response to the number of passes in the multi-pass recording method, prevent density irregularity and color unevenness, and prevent staining of the recording medium caused by contact between the recording head and the recording medium and blotting on the boundary between an area recorded in color and an area recorded in black, thereby recording a high-quality image.

[Third Embodiment]

A third embodiment of the present invention will now be described. In the following paragraphs, description will be omitted for portions similar to those described in the above-mentioned first and second embodiments, and the description will center around characteristic related to this embodiment.

In this embodiment, the recording method is changed in response to whether or not an area recorded with color ink is present in the recorded image.

Figure 22:
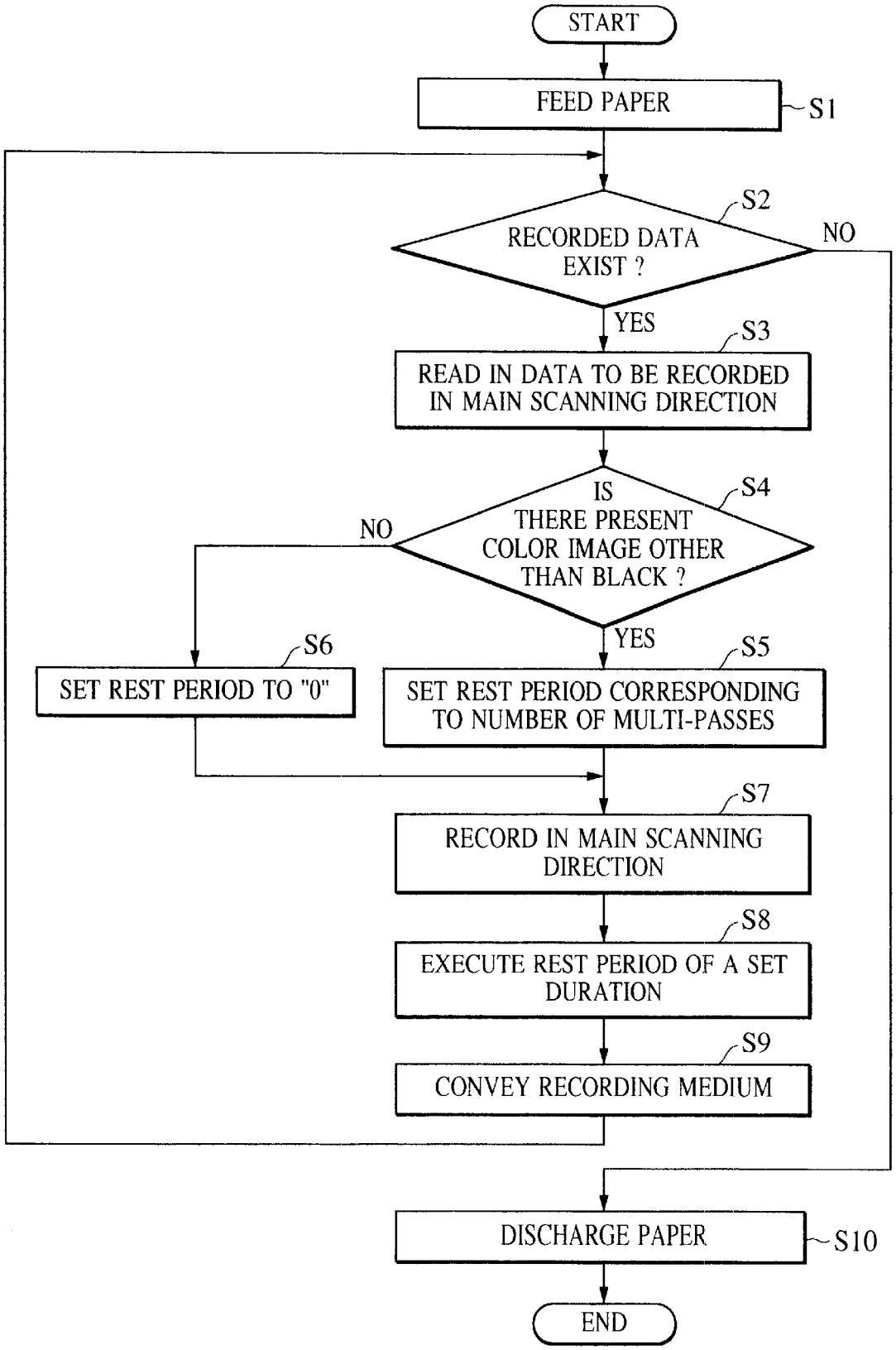
FIG. 22 is a flowchart illustrating operations in a third embodiment of the invention.

FIG. 22 is a flowchart illustrating operations in this embodiment. First in step S1, the paper is fed. In step S2, the presence or absence of recording data is determined. When the recording data is present, the data to be recorded in the main scanning direction are read in step S3, and in step S4, it is determined whether or not there exists a color image except for a black image.

When a color image exists, an optimum rest period corresponding to the number of multi-passes used in the second embodiment is set in step S5. That is, a rest period of 1.5 seconds is set for two-pass recording, and a rest period of 0.5 seconds is set for four-pass recording. When no color image exists, i.e., when the images are only black ones, it is better not to provide a rest period to prevent paper surface staining as shown in FIG. 21, because color unevenness, density irregularity or blotting on the boundary between the color image and the black image does not occur. In step S6, therefore, a rest period of 0 seconds is set. While a rest period of 0 seconds is set in step S6 in this case, throughput can be improved by setting a shorter rest period in the absence of a color image than in the presence thereof, because a long rest period is not necessary.

In step S7, recording is conducted in the main scanning direction. In step S8, the recording operation is discontinued for the set rest period. After conveying the recording medium in step S9, the process returns back to step S2 to determine whether or not the recording data is present. If the recording data are present, then step S3 and the subsequent steps are executed, as described above, and when no recording data exists, the paper is discharged in step S10, to complete the processing.

According to this embodiment, by conducting control of the rest period time as described above, it is determined whether or not there is present an area to be recorded with color ink in the recorded image, and multi-pass recording suitable for each case is executed. That is, when there exists an area to be recorded with the color ink, a prescribed rest period is provided after each run of scanning, and a time for the ink to penetrate into the recording medium and to be fixed thereto is ensured to prevent density irregularity, color unevenness, staining of the recording medium surface caused by contact between the recording head and the recording medium, and blotting on the boundary between an area recorded with color ink and an area recorded with black ink. On the other hand, when an area to be recorded with color ink is not present, the recording time is reduced by setting a shorter rest period. More specifically, the recording time can further be reduced to null. By adopting an optimum recording method in response to the image to be recorded, it is possible to record a high-quality image.

[Fourth Embodiment]

The fourth embodiment of the present invention will now be described. In the following paragraphs, the description will be omitted for the portions similar to those described in the above-mentioned first and second embodiments, and the description will center around characteristic relating to this embodiment.

In this embodiment, the recording method is changed, depending upon whether or not there is an area to be recorded with both the color ink and the black ink in the recorded image.

Figure 23:
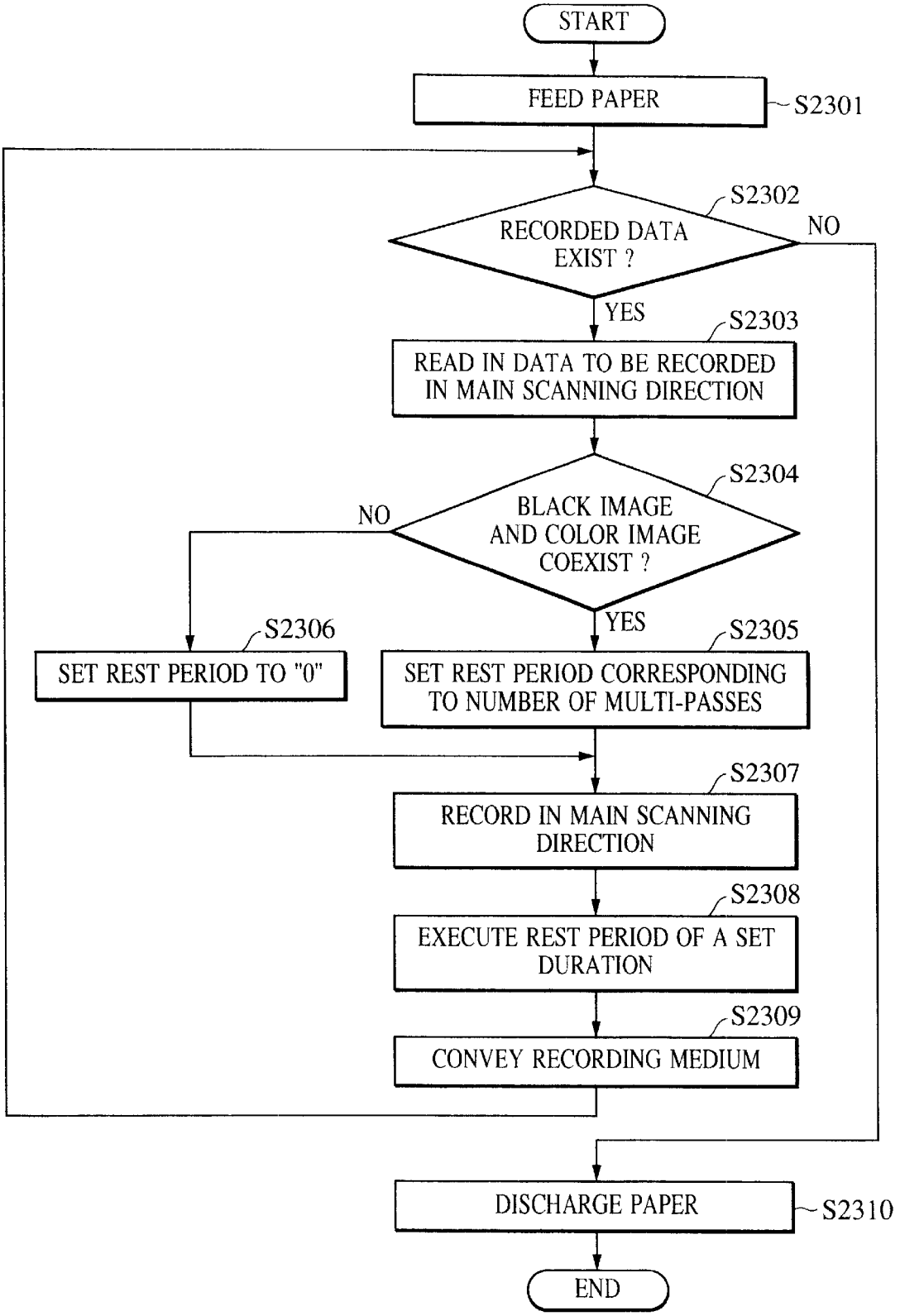
FIG. 23 is a flowchart illustrating operations in a fourth embodiment of the invention.

FIG. 23 is a flowchart illustrating operations in this embodiment. First in step S2301, the paper is fed, and in step S2303, the presence or absence of recording data is determined. When recording data are present, data to be recorded in the main scanning direction are read in step S2303, and in step S2304, it is determined whether or not both a black image and a color image are present.

When both a black image and a color image are present, an optimum rest period corresponding to the number of multi-passes used in the second embodiment is set in step S2305. That is, a rest period of 1.5 seconds is set for the two-pass recording, and a rest period of 0.5 seconds, for the four-pass recording. When both images are not present, i.e., when only a black image or only a color image is present, no blotting is produced on the boundary between the color and black images. It is preferable not to provide a rest period from the point of view of preventing paper surface stain. A rest period of 0 seconds is therefore set in step S2306. While a rest period of 0 seconds is set in this case, there is available an effect of improving throughput also by setting a shorter rest period than in a case where both black and color images are present.

In step S2307, recording is performed in the main scanning direction, and in step S2308, the recording operation is discontinued for the set rest period. After conveying the recording medium in step S2309, the process returns back to step S2302 to determine again the presence or absence of recording data. If recording data are present, step S2303 and the subsequent steps are executed as above. If recording data are not present, the paper is discharged in step S2310 to complete the process.

According to this embodiment, by conducting control of the rest period time as described above, it is determined whether or not an area to be recorded with both color ink and black ink is present in the recorded image, and multi-pass recording suitable for the determined case is executed. More specifically, when there is an area to be recorded by use of both color ink and black ink, a prescribed rest period after each run of scanning is provided to ensure a time sufficient for the ink to penetrate into the recording medium and to be fixed thereto, thus preventing blotting on the boundary between the area recorded with the color ink and the area recorded with the black ink. On the other hand, when there is no area to be recorded with both the color ink and the black ink, a short rest period is set, or more specifically, a rest period is not set to reduce the recording time. It is thus possible to record a high-quality image by an optimum recording method suitable for the image to be recorded.

[Variant of Fourth Embodiment]

From the point of view of more clearly presenting the prevention of blotting on the boundary between an area recorded with color ink and an area recorded with black ink, it is conceivable to change the setting of the rest period in response to whether or not the area recorded with color ink and the area recorded with black ink are in contact (or slightly spaced apart from each other).

Figure 24:
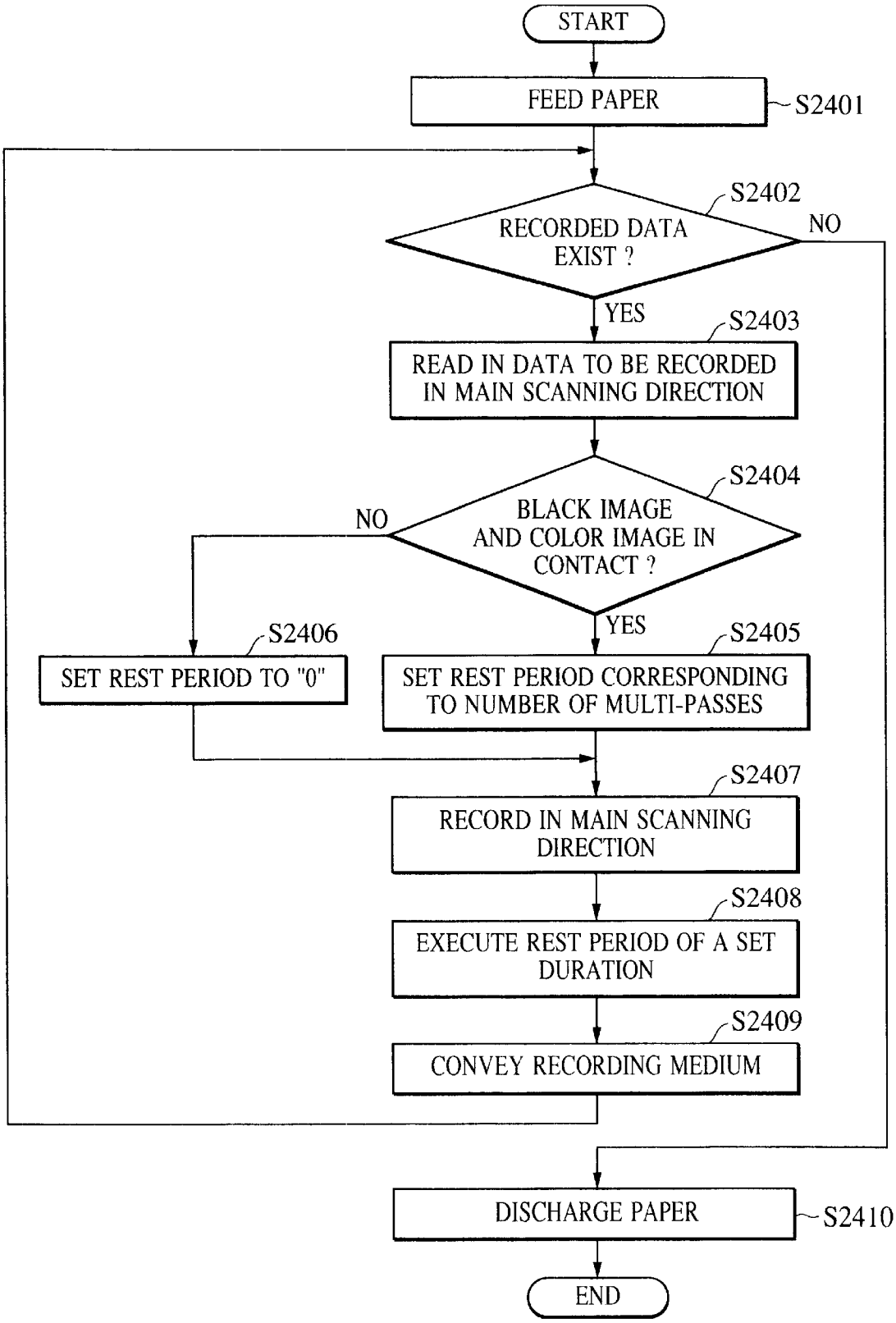
FIG. 24 is a flowchart illustrating operations in a variant of the fourth embodiment of the invention.

FIG. 24 is a flowchart illustrating the operation in the variant of the fourth embodiment in which it is determined whether or not an area recorded with color ink and an area recorded with black ink are in contact.

Operations in this variant and those in the fourth embodiment are different only in that it is determined in step S2304 whether or not the area recorded with color ink and the area recorded with black ink are in contact, with all the other steps being identical between the two.

Even when there exist both an area to be recorded with color ink and an area to be recorded with black ink, no blot is produced on the boundary between the area recorded with color ink and the area recorded with black ink if both areas are not in contact (or only slightly spaced apart from each other).

According to this variant embodiment, when the area recorded with color ink and the area recorded with black ink are in contact, blot on the boundary between the area recorded with color ink and the area recorded with black ink is prevented by ensuring a time for the ink to penetrate into the recording medium and to be fixed thereto by providing a prescribed rest period after each run of scanning. When the area recorded with color ink and the area recorded with black ink are not in contact, the recording time is reduced without providing a rest period. It is thus possible to record a high-quality image by applying an optimum recording method suitable for the image to be recorded.

[Other Embodiments]

In the aforementioned embodiments, it is possible to achieve a higher density and a finer accuracy of recording by providing means for generating heat energy serving as energy used for causing ink discharge (for example, an electro-thermal converter, laser beam or the like) and a method of causing a change in status of ink by the generated heat energy, in the area of the ink-jet recording methods.

Typical configurations and principles should preferably be based on a basic principle disclosed, for example, in U.S. Pat. Nos. 4,723,129 and 4,740,796.

The present invention is applicable to a system comprising a plurality of units (for example, a host computer, an interface device, a reader, a printer and the like) or to a unit comprising a single device (for example, a copying machine, a facsimile machine or the like).

The object of the present invention can be achieved also by feeding a recording medium recording software program codes materializing the functions of the aforementioned embodiments to a system or a unit, and reading out and executing, by means of a computer (or a CPU or an MPU) of such a system or a unit, the program codes stored in the recording medium.

In this case, the program codes themselves read out from the recording medium serve to materialize the functions of the aforementioned embodiments, and the recording medium storing the program codes constitute the present invention.

Not only does the execution of the program codes read out by the computer materialize the functions of the aforementioned embodiments, but also an OS (operating system) operating on the computer performs all or part of actual processes in accordance with instructions of the program codes, and this achieves the functions of the aforementioned embodiments.

The applicability, of course, covers a case in which the program codes read out from the recording medium are written into a memory provided in an expanded capability board inserted into a computer, or an expanded capability unit connected to the computer, and subsequently, a CPU or the like provided in the expanded capability board or the expanded capability unit, executes all or part of the actual processes in accordance with the instructions of the program codes, thus achieving the functions of the aforementioned embodiments.

When applying the present invention to the above-mentioned recording medium, the program codes corresponding to the tables and the flowcharts described above (shown in FIGS. 12, 13, and 22) are stored in the recording medium.

According to the present invention, as described above, a rest period can be set, taking into account the amount of ink discharged per unit time and per unit area, and the time required before the completion of recording, which vary with the number of runs of main scanning to the individual areas.

It is therefore possible to ensure a time for the ink to penetrate into the recording medium and to be fixed thereto, prevent density irregularity, color unevenness, blot between colors, and stain of the recording medium caused by contact between the recording head and the recording medium, thus recording a high-quality image.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus having main scanning means performing main scanning which moves a recording head discharging ink to a recording medium, and conducting recording by discharging the ink from said recording head onto the recording medium, together with said main scanning, comprising:

recording controlling means executing a plurality of runs of main scanning of said recording head by said main scanning means to a recording area of the recording medium, and performing multi-pass recording which completes an image on said recording area;

recording mode setting means which sets a recording mode from a plurality of recording modes with different number of runs of said main scanning by said multi-pass recording to said recording area; and rest period setting means which sets a rest period during which recording is discontinued after the individual runs of main scanning in said multi-pass recording, wherein said rest period setting means sets a rest period for a recording mode for carrying out more runs of said main scanning, shorter than the rest period for a recording mode for carrying out fewer runs of said main scanning.

2. An ink-jet recording apparatus according to claim 1, wherein said recording control means performs said multi-pass recording by causing said carriage to reciprocate.

3. An ink-jet recording apparatus according to claim 1, further comprising:

selecting means with which the user selects whether or not to provide said rest period after each run of main scanning.

4. An ink-jet recording apparatus according to claim 1, further comprising:

selecting means with which the user selects said rest period from a plurality of candidates.

5. An ink-jet recording apparatus according to claim 1, wherein:

color recording is conducted by discharging kinds of ink of a plurality of colors including black, cyan, magenta and yellow ones by means of said recording head; and said black ink has a lower penetrability into the recording medium than that of the kinds of ink of the other colors.

6. An ink-jet recording apparatus according to claim 5, further comprising:

area determining means for determining whether or not an area recorded in each run of main scanning by use of said main scanning means is an area to be recorded by use of both the black ink and a color ink; and a rest period changing means for setting different rest periods between said area to be recorded by use of both the black ink and the color ink and the other areas.

7. An ink-jet recording apparatus according to claim 6, wherein said rest period changing means sets a shorter rest period when recording an area recorded only with black ink than the rest period when recording the other areas.

8. An ink-jet recording apparatus according to claim 1, further comprising:

area determining means for determining whether or not a recording area corresponding to each main scanning carried out by said main scanning means is to be recorded by use of only black ink; and rest period changing means for setting different rest periods between said area to be recorded only with the black ink and the other areas.

9. An ink-jet recording apparatus according to claim 8, wherein said rest period changing means sets a shorter rest period for recording said area to be recorded only with the black ink than the rest periods for recording the areas other than said area to be recorded only with the black ink.

10. An ink-jet recording method which carries out main scanning by moving a recording head discharging ink to a recording medium, and conducting recording onto the recording medium by discharging ink from said recording head along with said main scanning, comprising:

a recording mode selecting step, of selecting a recording mode from a plurality of recording modes of different number of runs of said main scanning for said recording and when performing multi-pass recording which completes an image for said recording area by applying a plurality of runs of said main scanning to the recording area of the recording medium;

a rest period setting step, of setting a rest period during which recording is discontinued after each run of main scanning in said multi-pass recording in response to the number of runs of main scanning corresponding to said selected recording mode; and a step of conducting recording in response to the selected recording mode, wherein said rest period setting step sets a shorter rest period for a recording mode of a larger number of runs of main scanning than the rest period for a recording mode of a smaller number of runs of said main scanning.

11. A method according to claim 10, wherein the multi-pass recording is carried out by causing the carriage to reciprocate.

12. A method according to claim 10, further comprising:

a selection step in which the user selects as to whether or not the rest period is to be provided after each run of main scanning.

13. A method according to claim 10, further comprising:

a rest period selecting step in which the user selects the rest period from a plurality of candidates.

14. A method according to claim 10, wherein color recording onto the recording medium is conducted by discharging kinds of ink of a plurality of colors including black, cyan, magenta and yellow ones by means of the recording head; and the black ink has a lower penetrability into the recording medium than that of the kinds of ink of the other colors.

15. A method according to claim 14, further comprising:

an area determining step, of determining whether or not a recording area corresponding to each main scanning carried out in said main scanning step is to be recorded by use of only a black ink; and a rest period changing step, of setting different rest periods between the area to be recorded only with the black ink and the other areas.

16. A method according to claim 15, wherein a shorter rest period is set in said rest period changing step for recording said area to be recorded only with the black ink than the rest periods for recording the areas other than said the area to be recorded only with the black ink.

17. A method according to claim 14, further comprising:

an area determining step, of determining whether or not an area recorded in each run of main scanning by use of said main scanning means is an area to be recorded by use of both the black ink and a color ink; and a rest period changing step, of setting different rest periods between the area to be recorded by use of both the black ink and the color ink and the other areas.

18. A method according to claim 17, wherein a shorter rest period is set in said rest period changing step when recording an area recorded only with the black ink than the rest period when recording the other areas.

* * * * *

UNITED STATES PATENT AND TRADEMARK OFFICE

CERTIFICATE OF CORRECTION

PATENT NO. : 6,695,432 B2
DATED : February 24, 2004
INVENTOR(S) : Hidehiko Kanda It is certified that error appears in the above-identified patent and that said Letters Patent is hereby corrected as shown below:

Column 1,
Line 59, “roller,” should read -- rollers, --.

Column 11,
Line 4, “2msec” should read -- 2·msec --.

Column 14,
Line 10, “2003K,” should read -- 2003K; --;
Line 11, “2004;” should read -- 2004 --; and
Line 51, “along” should read -- along a --.

Column 15,
Line 10, “characteristic” should read -- characteristics --.

Column 16,
Line 3, “characteristic” should read -- characteristics --.

Column 20,
Line 34, “said” should be deleted.

Signed and Sealed this

Twentieth Day of July, 2004

JON W. DUDAS
*Acting Director of the United States Patent and Trademark Office*